US009895622B2

(12) United States Patent
Musliner et al.

(10) Patent No.: US 9,895,622 B2
(45) Date of Patent: Feb. 20, 2018

(54) CONSTRUCTION SYSTEM FOR CREATING A CUSTOMIZABLE PLAY SURFACE COMPOSED OF PRINTED ADHESIVE TAPE AND OTHER ACCESSORIES FOR AUTONOMOUSLY CONTROLLED MOBILE AGENTS

(71) Applicant: InRoad Toys, LLC, Crofton, MD (US)

(72) Inventors: Andrew J. Musliner, Crofton, MD (US); David Drykerman, Rockville, MD (US)

(73) Assignee: INROAD TOYS, LLC, Crofton, MD (US)

( * ) Notice: Subject to any disclaimer, the term of this patent is extended or adjusted under 35 U.S.C. 154(b) by 0 days.

(21) Appl. No.: 15/137,413

(22) Filed: Apr. 25, 2016

(65) Prior Publication Data

US 2016/0310858 A1 Oct. 27, 2016

Related U.S. Application Data

(63) Continuation-in-part of application No. 14/179,092, filed on Feb. 12, 2014, now Pat. No. 9,320,978.

(51) Int. Cl.
*A63H 18/00* (2006.01)
*A63H 18/02* (2006.01)
*A63H 18/16* (2006.01)

(52) U.S. Cl.
CPC ..... *A63H 18/021* (2013.01); *A63H 18/02* (2013.01); *A63H 18/16* (2013.01)

(58) Field of Classification Search
USPC ..... 446/71, 79, 81, 82, 85, 96, 97, 108, 118, 446/146, 175, 441, 444, 446, 476, 491; 428/323; 434/96, 97
See application file for complete search history.

(56) References Cited

U.S. PATENT DOCUMENTS

| | | | |
|---|---|---|---|
| 1,929,963 | A | 10/1933 | Youngberg |
| 3,967,031 | A | 6/1976 | Lambert |
| 4,401,050 | A | 8/1983 | Britt et al. |
| 4,576,675 | A | 3/1986 | Brux |
| 4,678,188 | A | 7/1987 | Johnson |
| 4,708,907 | A | 11/1987 | Flutti et al. |
| D294,714 | S | 3/1988 | Johnson |
| 4,825,763 | A | 5/1989 | Truskolaski et al. |

(Continued)

OTHER PUBLICATIONS

"Create a Road Tape with Toy Car Playset, My First Autobahn, 36 Yards X 2 Inch." Amazon.com: Create a Road Tape with Toy Car Playset, My First Autobahn, 36 Yards X 2 Inch: Toys & Games. Donkey, n.d. Web. Available at least as of Aug. 22, 2012. <http://www.amazon.com/Create-Playset-First-Autobahn-Yards/dp/B002TPYIPM/ref%3Dsr_1_1?ie=UTF8&qid=1398181487&sr=8-1&keywords=autobahn+tape>.

(Continued)

*Primary Examiner* — Kurt Fernstrom

(74) *Attorney, Agent, or Firm* — Leason Ellis LLP

(57) ABSTRACT

A customizable adhesive toy playscape is constructed of a combination of printed adhesive playscape tape and other accessories, such as printed stickers, upstanding signs, toy vehicles, and the tape roll core that can be used by children (or adults) for creating imaginary playscape tape worlds for play, education, or other uses. The playscape tape can be part of a two-layer track construction that includes machine-readable codes for controlling movement of a mobile agent traveling thereover.

36 Claims, 11 Drawing Sheets

(56) References Cited

U.S. PATENT DOCUMENTS

| | | | | |
|---|---|---|---|---|
| 4,842,194 | A | 6/1989 | Halbert | |
| 4,913,946 | A | 4/1990 | Sala et al. | |
| D309,646 | S | 7/1990 | Halbert | |
| 4,989,801 | A | 2/1991 | Thomas et al. | |
| 5,000,715 | A | 3/1991 | Johnson | |
| 5,168,002 | A | 12/1992 | Maietti | |
| 5,212,011 | A | 5/1993 | Ishikawa et al. | |
| 5,326,267 | A | 7/1994 | Brokaw | |
| 5,389,438 | A | 2/1995 | Miller et al. | |
| 5,622,761 | A | 4/1997 | Cole | |
| 5,816,886 | A * | 10/1998 | Cusolito | A63H 5/00 434/171 |
| 5,858,495 | A | 1/1999 | Eikmeier et al. | |
| 5,950,321 | A | 9/1999 | Pena et al. | |
| 5,989,708 | A | 11/1999 | Kreckel | |
| 6,004,665 | A | 12/1999 | Luhmann et al. | |
| 6,059,657 | A * | 5/2000 | Oh | A63F 9/143 250/206.1 |
| 6,120,866 | A | 9/2000 | Arakawa et al. | |
| 6,280,840 | B1 | 8/2001 | Luhmann et al. | |
| 6,350,517 | B1 | 2/2002 | Wu | |
| 6,372,335 | B1 | 4/2002 | Lühmann et al. | |
| 6,386,415 | B1 | 5/2002 | Tsai | |
| 6,395,389 | B1 | 5/2002 | Lühmann et al. | |
| 6,403,206 | B1 | 6/2002 | Bries et al. | |
| 6,409,091 | B1 | 6/2002 | Simpson | |
| 6,410,135 | B1 | 6/2002 | Hamerski et al. | |
| 6,503,618 | B1 | 1/2003 | Jakobi et al. | |
| 6,511,466 | B1 | 1/2003 | Nagami | |
| 6,521,337 | B2 | 2/2003 | Yanagiuchi | |
| 6,554,685 | B2 | 4/2003 | Lish | |
| 6,647,893 | B1 | 11/2003 | Fugitt et al. | |
| 6,695,668 | B2 * | 2/2004 | Donahue | A63H 18/16 446/175 |
| 7,676,948 | B2 | 3/2010 | Miles | |
| 7,758,399 | B2 * | 7/2010 | Weiss | A63H 17/00 235/462.03 |
| 8,245,807 | B2 | 8/2012 | Frank et al. | |
| 8,282,438 | B2 | 10/2012 | Tamulewicz et al. | |
| 8,747,182 | B2 * | 6/2014 | Sofman | A63H 17/40 446/446 |
| 8,905,815 | B2 * | 12/2014 | Keating | A63H 17/395 446/454 |
| 9,238,177 | B2 * | 1/2016 | Sofman | A63H 17/40 |
| 2001/0003872 | A1 | 6/2001 | Pederson | |
| 2001/0006726 | A1 | 7/2001 | Arakawa et al. | |
| 2010/0112337 | A1 | 5/2010 | Coben | |

OTHER PUBLICATIONS

"Civil Engineer Tape: Copernicus Toys." Civil Engineer Tape: Copernicus Toys. N.p., n.d. Web. Available at least as of Dec. 21, 2013. <https://www.copernicustoys.com/proddetail.php?prod=TCIV>.

"Roommates RMK1720SCS Build-A-Road Peel and Stick Wall Decals." Amazon.com: Roommates RMK1720SCS Build-A-Road Peel and Stick Wall Decals: Home Improvement. N.p., n.d. Web. Available at least as of Dec. 2, 2011. <https://www.amazon.com/ROOMMATES-RMK1720SCS-Build-A-Road-Stick-Decals/dp/B006DDYOX2/ref%3Dsr_1_fkmr0_1?ie=UTF8&qid=1398188077&sr=8-1-fkmr0&keywords=playmat+road+stickers>.

* cited by examiner

CONSTRUCTION SYSTEM FOR CREATING A CUSTOMIZABLE PLAY SURFACE COMPOSED OF PRINTED ADHESIVE TAPE AND OTHER ACCESSORIES FOR AUTONOMOUSLY CONTROLLED MOBILE AGENTS

CROSS-REFERENCE TO RELATED APPLICATION

The present application is a continuation-in-part of U.S. patent application Ser. No. 14/179,092, filed Feb. 12, 2014, which is hereby incorporated by reference in its entirety.

TECHNICAL FIELD

The present invention relates to games and toys and more particularly, to a construction system that includes a number of different pieces, including a simulated surface (e.g., a road) printed on adhesive tape, that permit a child to create unique and customizable playscapes that are removably attached to a play surface, such as a floor or countertop.

BACKGROUND

There is a wide array of different toys, games, and toy construction systems that are intended to entertain not only children but also adults.

One particular category of toys that is a favorite of children, especially boys, is toy cars. Toy cars are typically used on hard surfaces, such as a floor or countertop or the like. Children drive toy cars on imaginary or physically represented toy roads that are part of a broader playscape.

While there are some toys for constructing roads and playscapes for use with toy cars, these existing products suffer from a number of deficiencies, as noted below, that the present invention solves.

One particular toy product is a toy racetrack, on which a car travels along a fixed-path, semi-enclosed plastic track. Such racetrack is sold in sections and interconnects using a variety of proprietary connection pieces. This racetrack is expensive to purchase, bulky to store, cumbersome and in-the-way when constructed, and offers limited flexibility for arbitrary playscape design, particularly because vehicles travel explicitly in a single lane and the racetrack can only be assembled end-to-end in a pre-defined fashion, often in a pre-defined configuration suitable for downhill racing only. By contrast, the present invention provides the ability to construct fully arbitrary playscapes for imaginative play, is far lower cost, is easier to use, requires little storage, is not in-the-way when constructed, and is removable and disposable.

Another type of product is a plastic building and road set that, in some cases, interconnects with plastic racetrack and incorporates buildings with certain features (such as a "car wash" or an "auto lift"). This set is difficult and complex to assemble (requiring adult assembly typically), offers only a fixed play configuration, is extremely cumbersome to store, is frustrating for a small child because of its penchant for coming apart, and costly. By contrast, the present invention requires no adult assembly, is easier to use, enables the child to construct fully arbitrary playscapes for imaginative play, is far lower cost, requires little storage, is not in the way when constructed, and is removable and disposable.

Other products are elastic or carpet mats that have a pre-defined set of roads printed on the mat on which the child can drive his toy cars. Such mats are inflexible in their ability to foster creative play because they have but a single playscape design pre-printed on the mat. The plastic mats are dangerous if left unattended because they are very slippery. Carpet mats are similarly restrictive in their play value and are costly. Especially for the carpet mats, storage is a big challenge. These mats provide no construction capability, being a fixed design. By contrast, the present invention enables the construction of arbitrary playscapes, requires little storage, is not slippery or dangerous when constructed, and is far lower cost.

Currently a remote or radio control car user would need to either play with this vehicle in a large outdoor area if they wanted to use their car on a simulated track. Their other option for use is indoors, which could contain many obstacles and offers a much smaller space. The outdoor option allows for freedom to make turns, accelerate in speed and generally not disturb an indoor area such as walls or furniture inside a home or building. Many of these RC users play on man-made large tracks created of dirt or other material designed for these types of vehicles. These tracks are designed and laid out by professional racing designers and the users and owners of the vehicles would use the track to test their skill, but these professional tracks do not allow for the free-play and creative design discussed here. The RC market of toy vehicles could be designed to communicate electronically with a track beneath it and have little to no need for the actual remote control itself. The track could be embedded with readable codes that would be read by the vehicle and allow the vehicle to move flawlessly on its own. This entire change in the dynamic of play with these types of vehicles allow for users to experience creativity and enjoyment of watching their vehicle at work without doing all of the work themselves.

Slot cars also exist whereby they can drive in a slotted or carved out lane on a track and move automatically. These track designs allow for limited creativity in their layout and simply allow the user to watch a car go around and around the track on its own with no controls. The slot car vehicles on this type of track typically operate at different speeds throughout their drive around the track and have no deviation in turns and move along the exact slotted layout they are placed into on the track.

One commercially available track is available from Anki, Inc. (Anki). The track from Anki includes a working surface for the toy vehicles or mobile agents that has a two-layer system. A mobile agent is otherwise known as a toy vehicle. The track consists of a bottom layer with an intricate and secured system of machine readable codes. This lower layer is then covered with a material that is the top, drivable layer. The top layer of the Anki track is a shiny black material that is aesthetically appropriate for a car or other mobile agent to drive on similar to a real track used in racing. However, this shiny black track has no graphics, look or feel of a real road or track other than that it is black like asphalt. This track material can have straight parts as well as has curves but the top layer is only a covering for the bottom layer which not only is the design of the track but contains the codes that will allow the car/mobile agent to move and understand the layout of the road ahead. The top layer itself is not a key to or even a participant in the system that enables mobile agents to move properly on the track. The bottom layer of intricate codes leads the mobile agent to turn and control speeds while the top layer allows for the track system as a whole to aesthetically appear as a track or a road. Details of the Anki system are disclosed in U.S. Pat. Nos. 9,238,177 and 8,747,182, each of which is hereby incorporated by reference in its entirety.

The Anki two-layer system is constructed to show vehicles going around a track that contains hills, turns and straight sections by communicating via infrared technology on the vehicle with the coding on the bottom layer of the track. The naked human eye could see the fact that a track contains turns or uphill/downhill features, but a regular mobile agent/car would most likely flip on a turn or go too fast down a hill and fall off the track. With the readable codes and the infrared light located inside the car, the combination of these two concepts allows a car to slow, accelerate or turn so that it flows perfectly over the surface and can round the track properly. These designs allow for the user to have continuous play.

This type of system requires that an initial mapping be performed by the mobile agent(s) and in particular, each mobile agent on the track slowly drives around the track while ingesting the machine-readable codes embedded in each track segment. Once the mobile agent reads the track layout, each mobile agent can share the information with other mobile agents.

A user interface, such as a tablet or smartphone, is used to control the speed of the mobile agent and left and right turning of the mobile agent so as to allow the mobile agent to steer back-and-forth across the track. For example, a first slider is provided for controlling the speed of the mobile agent and the vehicle can be steered by tilting the user's mobile device (tablet or smartphone) on which the user interface is displayed. In particular, tilting the mobile device allows the vehicle to switch between a plurality of "lanes" that are defined on the track. It will be appreciated that the separate lanes are typically not visually identifiable by a human but instead are part of the machine-readable codes which in part uses printed markings (machine-readable codes) to define such lanes.

While the Anki track is satisfactory for its intended use, it has the following limitations:

- The top layer is plain black in look and design and does not have road lines or designs of actual obstacles which could coordinate with the code layer below to give the user a more realistic view of the road lanes or cars swerving around items such as garbage, road kill, speed bumps, etc.
- The track has a price to the public which can be expensive for many users.
- The track is only realistic in terms of the car racing experience because the road is black, but it does not include any indicia of a real racetrack, road or off-road experience.
- In addition to including no graphics showing that the track is a real track or road, the current track also contains no graphic or indicia of any obstacle which might be commonly seen on a regular road or track such as bumps, pot holes, oil spills, puddles, debris, or intentional obstacles such as spike strips. These obstacles could be used in coordination with the readable codes to allow for a car to swerve throughout its ride to avoid these obstacles making the racing process more enjoyable.
- The current track due to its size and material must be built by the user and laid out in an open area. When not in use the user has two options: either leave the track in place and occupy the usable space in a room or take apart each piece and component of the track and put it away taking up substantial storage space and time, only to have to re-build the track for play at another time.
- In addition, the movement of the mobile agent is fairly routine in that only the speed and turning (switching lanes) of the mobile agent is controlled and thus, the mobile agent can only effectively run laps around the track.
- The track itself is not affixed to the surface on which it is laid, making it easily susceptible to jostling, disruption, or dismantling by an errant foot or hand. This is a common problem with all pieced-together track systems and in this respect are frustrating to use.
- The top layer itself is not a key to or even a participant in the system that enables mobile agents to move properly on the track limiting both the visual and driving experience to that which is pre-coded in the bottom layer.

Accordingly, there is a need for a construction system for creating a customizable play surface for mobile agents that provides a more realistic racing and driving experience where the track itself is inexpensive, more flexibly constructed for a more varied play experience, securely attached to the surface on which it is laid, and easily stored and transported, and even discarded and recycled.

SUMMARY

In accordance with another aspect of the present invention, a track is constructed using an adhesive tape product (e.g., playscape tape as described herein). In one aspect of the present invention, a physical method of building a two-layer track for autonomously controlled mobile agents is provided. The track is constructed by combining a two-layer system composed of a top layer (playscape tape) with a bottom track layer having adhesive material on its underside in one embodiment. The construction of this two-layer track system allows mobile agents in the form of cars (or any other mobile agent such as a truck, off-road vehicle or robot) with infrared sensing to drive and move seamlessly on the track. The bottom and top layer can both be made of paper with the bottom layer having the adhesive material on the bottom so that the track can be stuck to any surface for play. This paper adhesive product is presented to the user in a rolled up format with a core so that the user can have mobility and easy portability of the track. The adhesive will allow use on many different surfaces with no harm to the underlying material (tile, wood). The bottom layer includes machine-readable codes or the like that are sensed by the mobile agent car to control movement of the car and/or otherwise send location or other sensed information to a base station or the like. The mobile agents themselves may be controlled autonomously, via a remote control, or via a combination of autonomous and remote control.

Other features and embodiments of the present invention are discussed below.

BRIEF DESCRIPTION OF THE DRAWING FIGURES

DETAILED DESCRIPTION OF CERTAIN EMBODIMENTS

Figure 1:
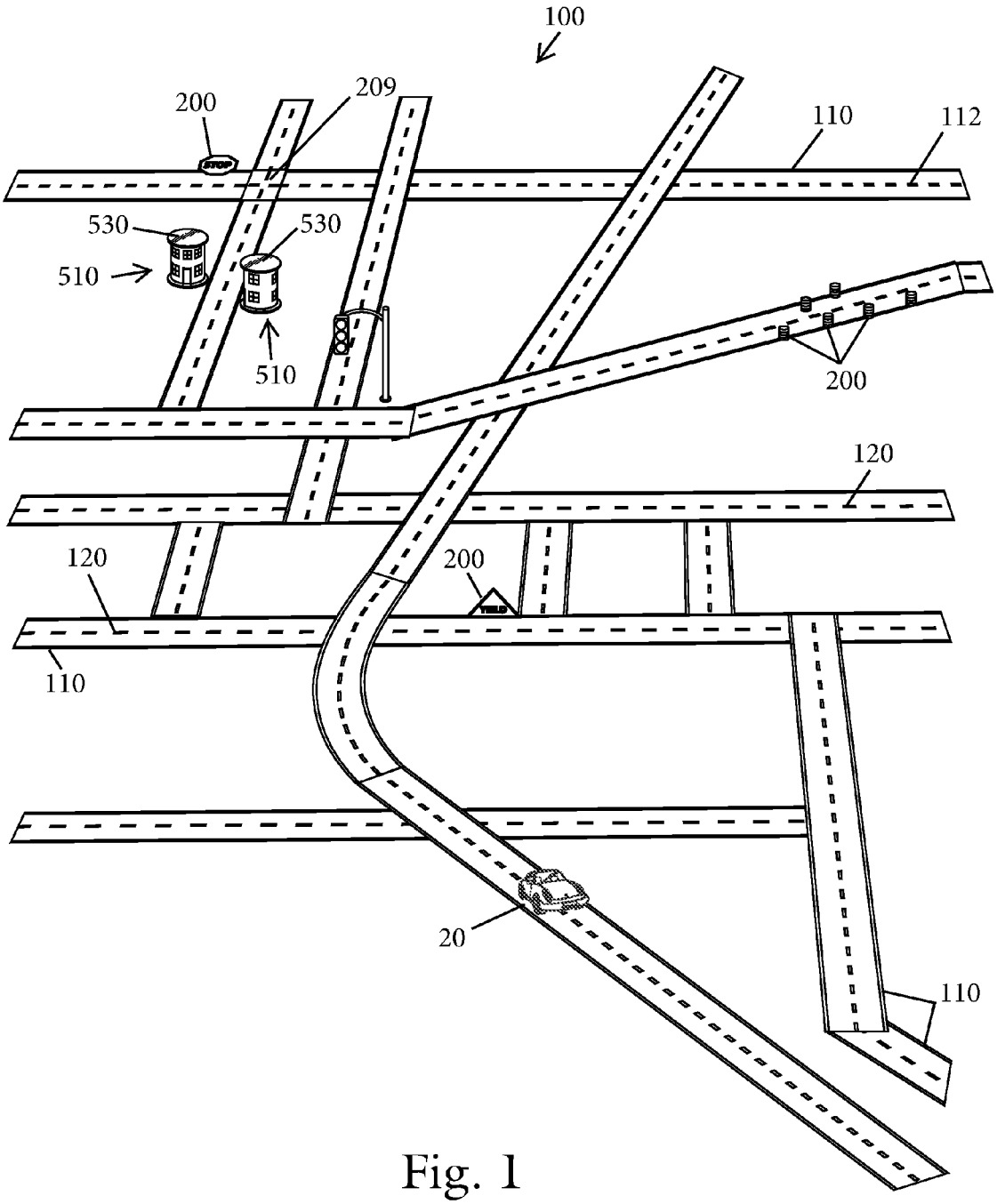
FIG. 1 is a perspective view of a playscape (play surface) constructed according to one embodiment of the present invention.

FIG. 1 is a perspective view of a custom playscape 100 (playsurface) in accordance with one embodiment of the present invention. As will be appreciated by the below discussion, the playscape 100 is based in part on the use of elongate flexible strips of material (i.e., playscape tape) 110 that contain printed indicia 120 or the like on an outer (upper) face 112 thereof and which are used by a user (e.g., a child) to construct a user definable playscape (play surface) as shown. As mentioned herein, the playscape tape 110 is preferably formed of a material (e.g., a paper based material) that can be cut or torn by the hand of the user without the use of a cutting implement, such as scissors or a knife. This allows a child to easily customize the overall playscape without the use of a potentially dangerous tool that require parent involvement and/or supervision.

Since the playscape tape 110 is preferably formed from a paper material, the printed indicia 120 can be applied using an ink printing process or the like. In other words, the applied ink is absorbed into the paper substrate the forms the tape 110 as opposed to merely being applied to a top surface. Advantageously, the absorbed ink does not easily rub off onto the child. In addition, when the playscape tape 110 depicts a road surface, such road requires a continuous print along the entire length of the tape such that there is no visible seam in the road as the design is repeated. This is challenging to perfect as part of the manufacturing process and the use of inks and paper substrate facilitates such seamless pattern. In addition, when inks and a paper substrate are used, the tape (e.g., road) is printed so that it "bleeds" to the edge. In other words, the printing goes right to the edge of the tape roll. There is no "allowance" or edge that cannot be printed on.

The above use of paper substrates and ink printing techniques is in contrast to other tapes which are made of plastics and the print easily rubs off. The use of plastic based tapes likewise prevents the above mentioned benefits from being realized.

In one embodiment, the printed indicia 120 simulates a road, highway or street for use with one or more toy vehicles 10 which can travel over the upper face 112 of the tape 110. In other embodiments described below and shown in other figures, the printed indicia 120 is not limited to a surface on which a vehicle travels but can be directed to natural surfaces, such as grass, rocks, mud, or metallic based surfaces, such as a bridge, or can relate to a surface which is restricted to pedestrian traffic such as a sidewalk or pedestrian walkway or bridge, etc. (See, FIG. 4).

The elongate playscape tape 110 has an adhesive material on a lower surface thereof which is configured to allow the lower surface of the tape 110 to be releasably attached to a support surface, as a floor, wall, table, carpet, desk, countertop, etc. The present invention contemplates that the playscape tape 110 is made of self-stick tape known (commonly referred to in the tape industry as pressure sensitive tape), since a pressure-sensitive tape is the easiest to use and most appropriate for child play. However, the present invention also contemplates that playscape tape 110 may be water-activated, heat-activated, gummed, or other non-pressure sensitive tape for a given application. The playscape tape 110 may optionally have a backing material or film that must be removed prior to use. Any number of different adhesives can be used so long as they are suitable for the intended applications described herein. For indoor use, for instance, a suitable adhesive is one in which the playscape tape 110 is secured (attached) (preferably uniformly) to the support surface but the playscape tape 110 can be subsequently removed from the support surface by lifting the playscape tape 110 and preferably, no residue is left on the support surface and no marring of the support surface results. For example, suitable adhesives (e.g., similar to adhesives used on masking tape, sticky notes, or painter's tape, etc.) are commercially available from a number of different sources.

Figure 8A:
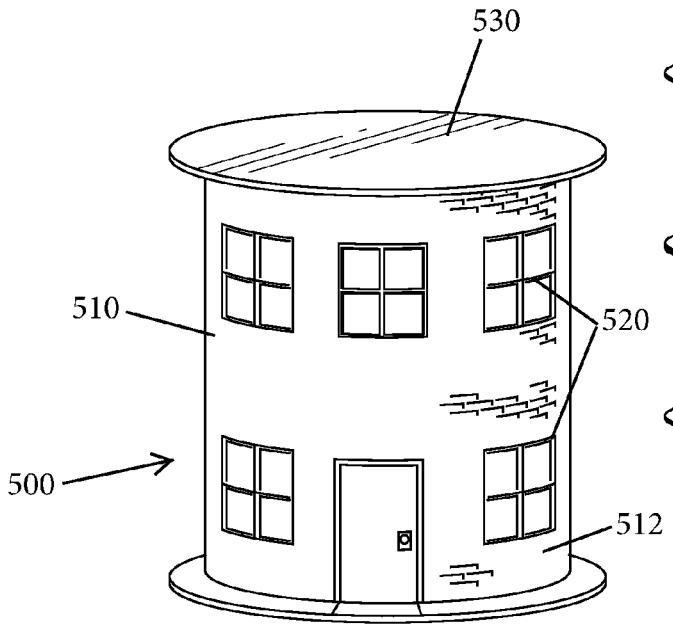
FIG. 8A is a perspective view of the tape roll core (that the playscape tape is unwound from) for the playscape tape shown in a first state that represents an accessory for use with the playscape tape during play.
Figure 8D:
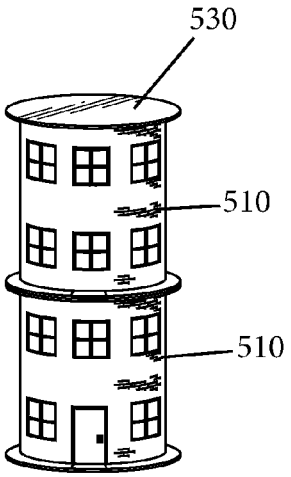
FIG. 8D is a perspective view of a pair of stacked tape roll cores.
Figure 8B:
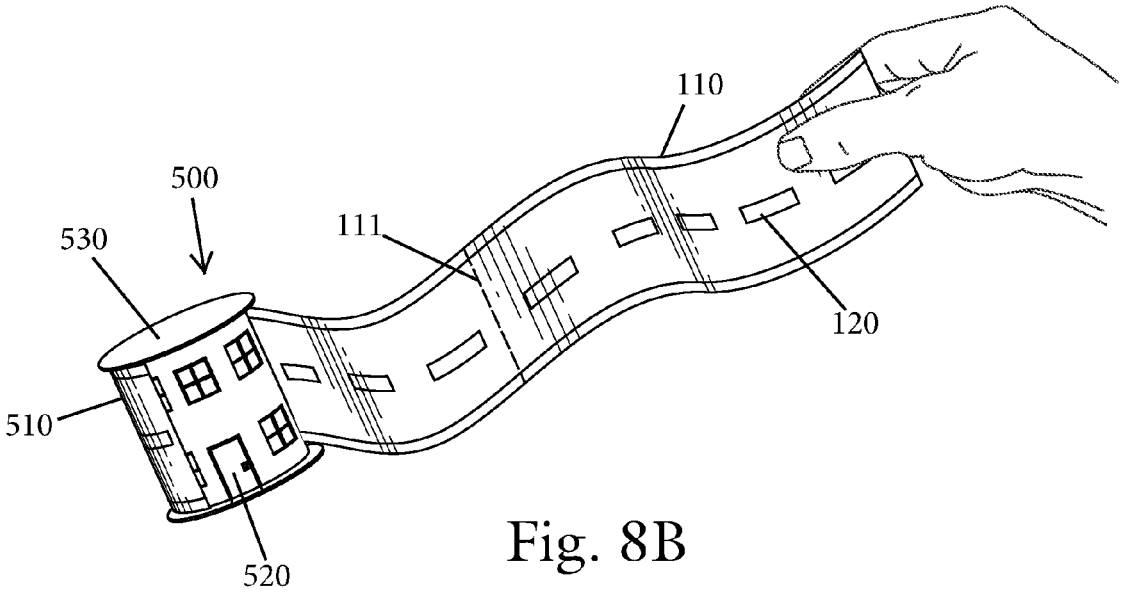
FIG. 8B is a perspective view of the tape roll core in a converted second state.

The material from which the playscape tape 110 is formed is preferably of a type that permits the playscape tape 110 to be easily segmented as by a tearing action by the user (without the use of a tool, such as scissors). However and alternatively, the playscape tape 110 can be formed of a material that is more robust and requires the use of cutting tool (scissors) to cut the tape 110 to a desired length. Alternatively and as shown in FIG. 8B, the tape 110 can include perforations 111 or the like which permit the playscape tape 110 to be easily segmented as by tearing the playscape tape 110 along the perforation(s) 111. The user can thus select the length of the playscape tape segment by selecting which perforation 111 is to be ruptured. This versatility with respect to tape length allows the user (child) to be able to customize the playscape in that a long road segment can be combined with a shorter road segment, etc., and a complex road or landscape can be created.

FIG. 1 illustrates a series of playscape tape segments 110 of different length with some tape segments 110 intersecting one another to create traffic intersections. It will be appreciated that the user can customize and completely design a road or landscape based entirely on the user's wishes and thoughts. The user can easily simulate and replicate road and landscape of familiar places such as a local town or city. The user can also consult a map or the like to duplicate a chosen locale. For example, the user can lay down playscape tape 110 so as to create a simulated New York City landscape with playscape tape segments defining the borders (sides and ends) of the island of Manhattan and various other playscape tape segments 110 present between these border playscape tape segments for representing streets such as Broadway, etc. Alternatively, the user can create a fictional road or landscape.

Figure 2:
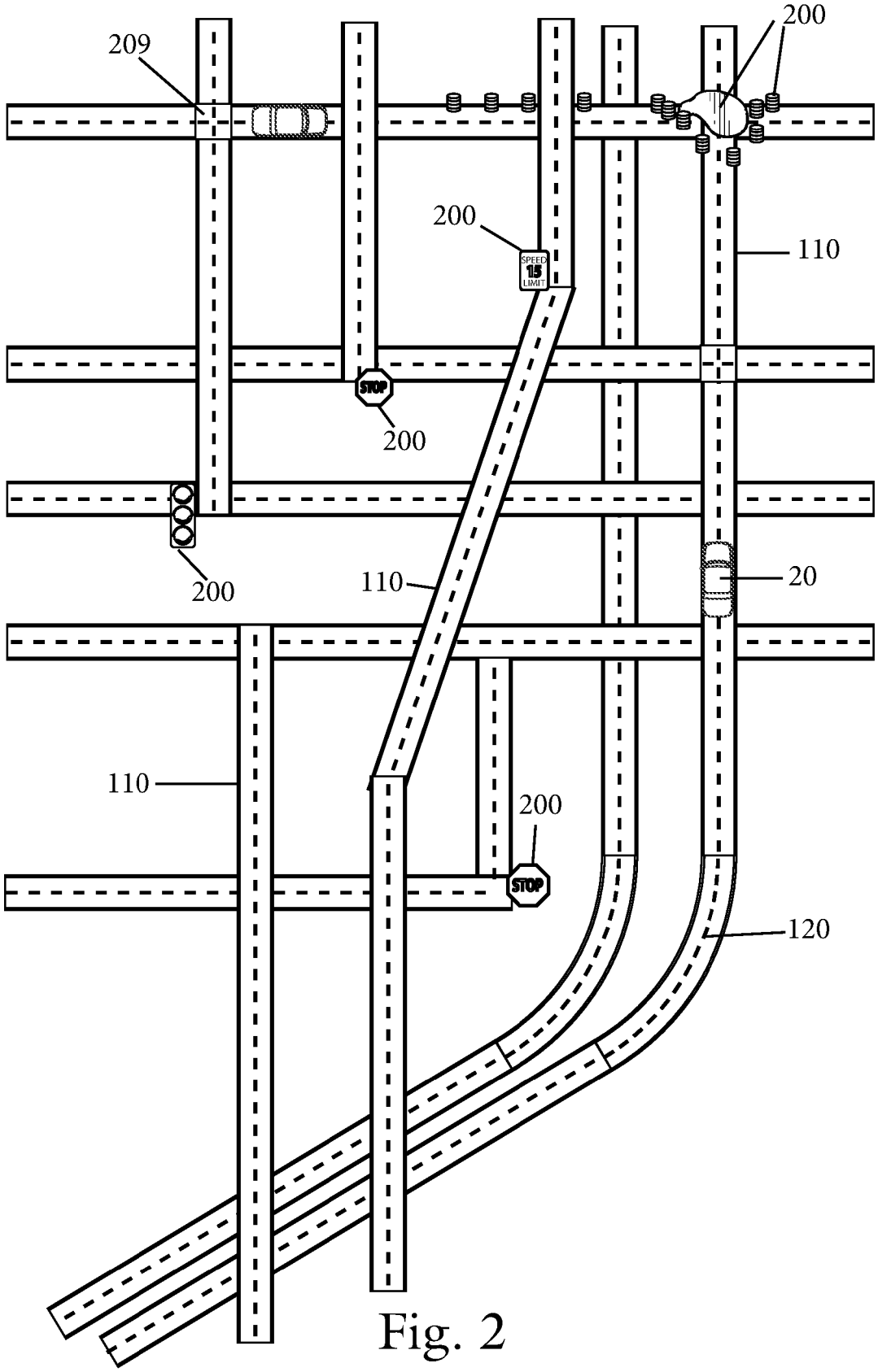
FIG. 2 is a top plan view of a playscape (play surface) constructed according to another embodiment of the present invention.

FIG. 2 illustrates yet another playscape 101 that illustrates the ease with which a customized playscape can be created.

As described herein, it is intended that other accessories are used in combination with the playscape tape 110. For example, toys, such as vehicles 20 or the like, can be used by a user who can roll the toy vehicle 20 over the playscape tape 110, thereby simulating driving the vehicle 20 along the road(s). Preferably, the road indicia 120 and the vehicle are to scale in that the vehicle can fit within one lane of the road or otherwise be contained within the natural, realistic boundaries contained as part of the indicia 120. For example, 1:64 scale for use with 1:64 toy vehicles and 1:128 scale for toy vehicles half that size. The 1:128 scale roads are reasonably 50 mm wide (2-lane, single dotted line down the center) and the 1:64 scale roads are reasonably 100 mm wide.

Other accessories that can be used as part of the playscape 100 include but are not limited to stickers and three dimensional toy pieces, such as traffic signs, buildings, signs, fences, natural landscape, such as trees, shrubs, etc.

Figure 7:
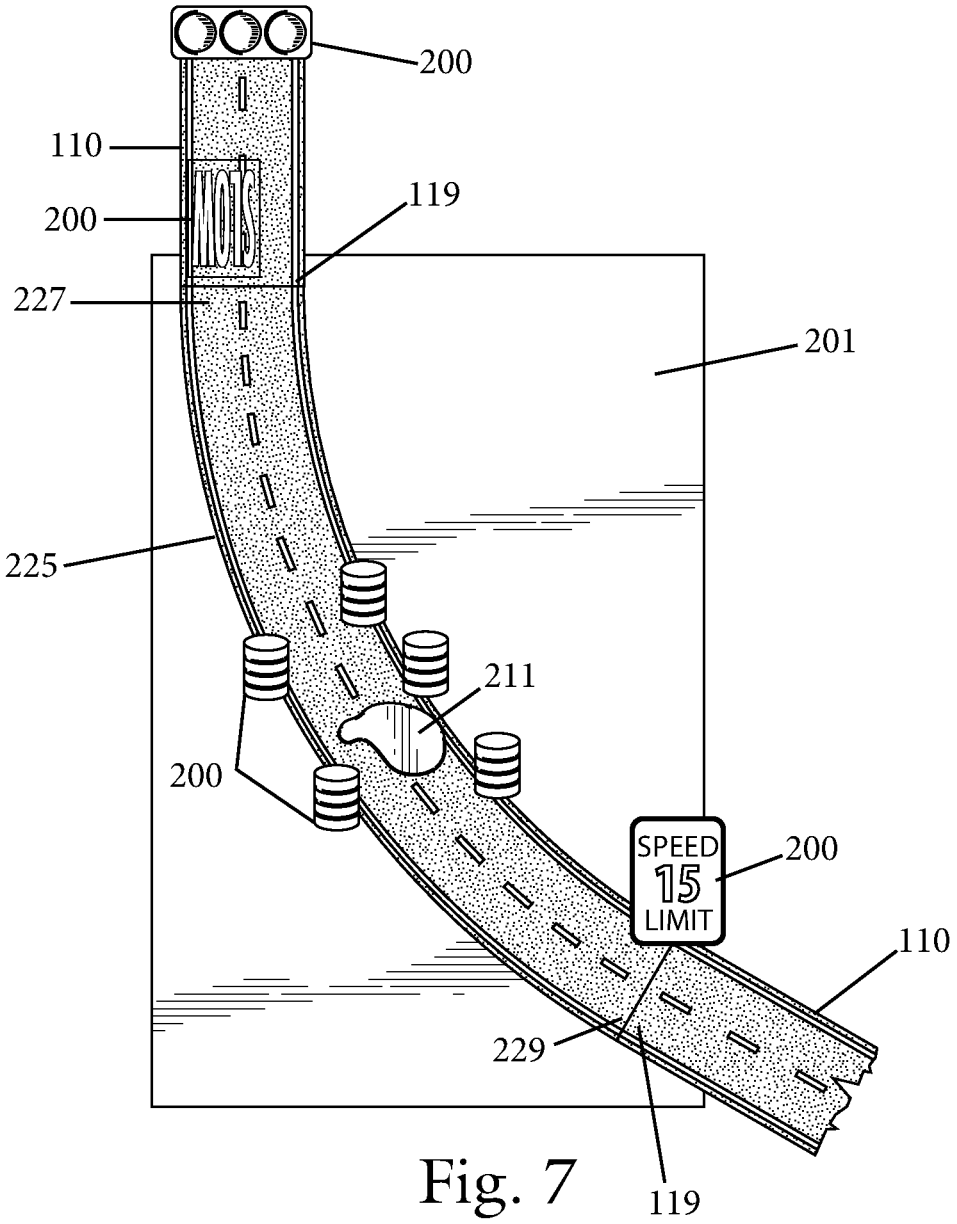
FIG. 7 is a top plan view of a segment of playscape tape including one or more stickers and further including optional accessories that can optionally be used in combination with the sensor-based system shown in FIG. 6.

FIGS. 1, 2 and 7 illustrate the use of stickers 200 as part of the play experience. The stickers 200 are thematic, pressure-sensitive stickers that enhance the specifics of any playtime scenario. In FIG. 7, the barrels, oil slick, speed limit, and traffic light are all examples of stickers 200. The stickers 200 can be die cut or perforated as individual units. The stickers 200 can be sold on sheets, individually, in packs, in trading packs, or on dispensable rolls. The stickers 200 provide the ability to customize and provide real-life accuracy to the playscape, providing pre-made intersections (where streets cross), curves and other variations where the sticker 200 provides a more detailed lifelike perspective. When the playscape tape 110 and stickers 200 are combined, the user has an endlessly variable way to create road configurations. The concept of creating your own neighborhood in a playscape tape world is easily within reach.

The stickers 200 can be of any size. The size is dependent both on the playscape tape world to which it is relevant (e.g., roads and cars vs. rivers and boats) and on the item the sticker 200 represents. Small stickers can be used to represent a pothole or the like, while larger stickers can represent buildings that line the road.

The following are exemplary play sticker themes:

Intersection and Curve Examples

| T intersection | X intersection | Y intersection |
|---|---|---|
| Railroad crossing | Bridge crossing | Cloverleaf |
| Merge | Curves right and left of varying degrees | S-curve |

-continued

| T intersection | X intersection | Y intersection |
|---|---|---|
| U-turn/No U-turn | S-curve (and other curve warnings) | |

Sign Examples

| | | |
|---|---|---|
| Stop | Yield | Children crossing |
| School | Train tracks | Construction |
| Merge | No turn on red | Hospital |
| Airport | Set speed limit | Do not pass |

Light Examples

| | | |
|---|---|---|
| Traffic light | Street light | Construction zone lights |
| RR crossing lights | | |

Hazard Examples

| | | |
|---|---|---|
| Pothole | Oil slick | Trash in road |
| Bump in road | Puddle | Accident |
| Parked car | Washout from flood | Electric line down |
| Tree across road | Snow drift | Land mine |
| Tire spikes | Barricade | Pedestrian |
| Gully | | |

Figure 3A:
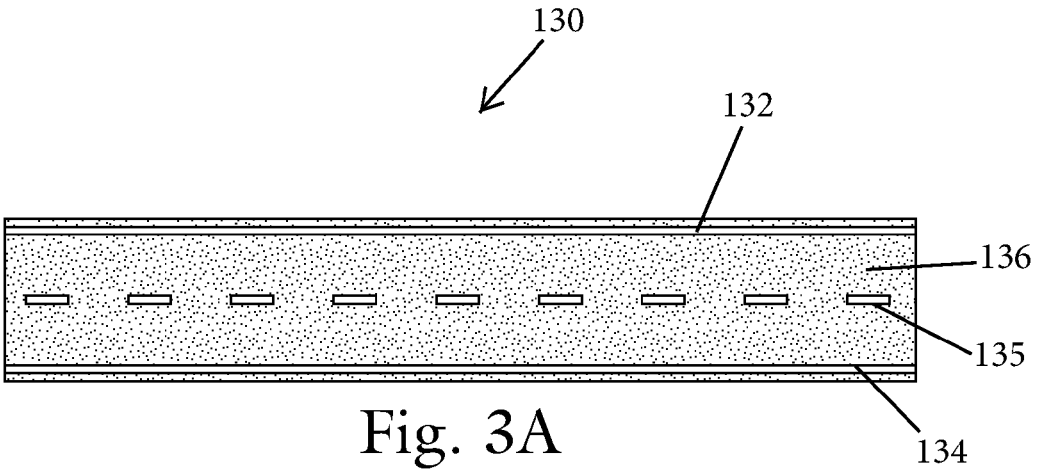
FIG. 3A is a top plan view of a single-lane playscape tape road segment.
Figure 3B:
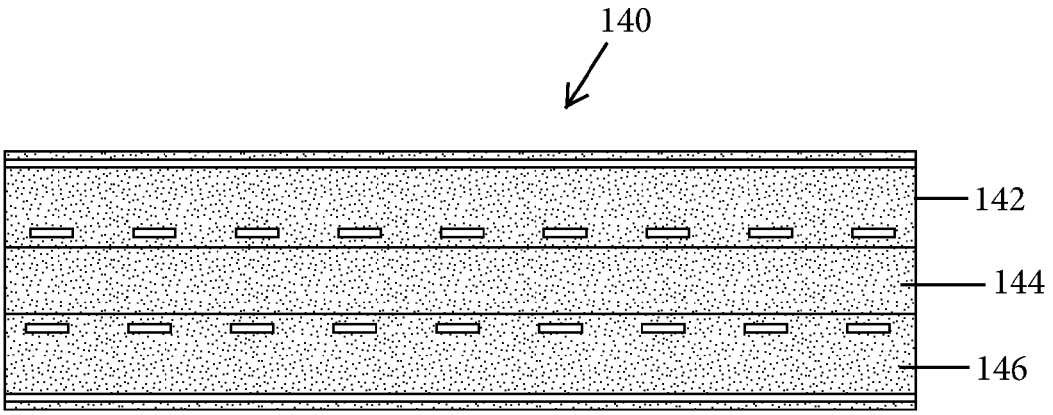
FIG. 3B is a top plan view of a multi-lane highway segment constructed of multiple single-lane playscape tape roads.
Figure 3C:
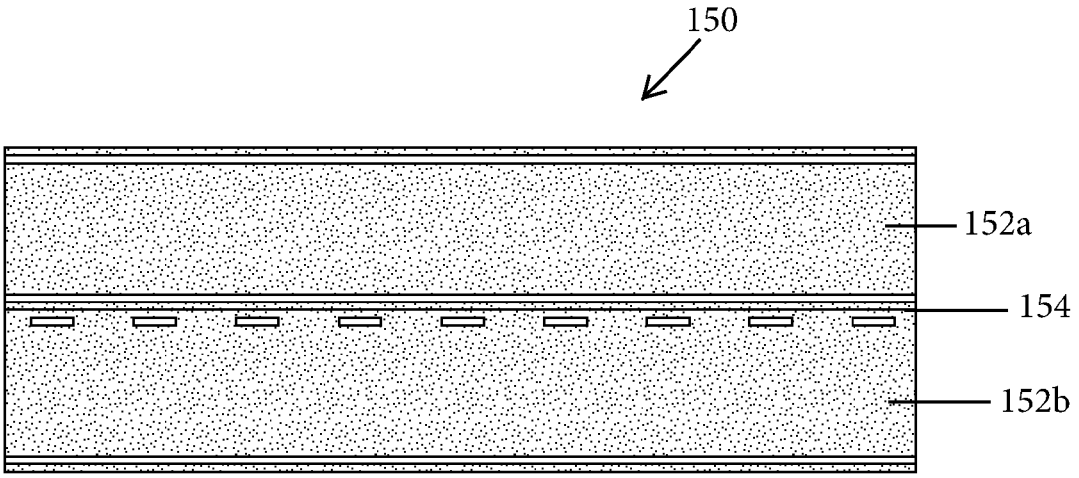
FIG. 3C is a top plan view of a two lane road segment constructed of two single-lane playscape tape roads.

FIGS. 3A-C show different possible types of roads; however, it will be appreciated that other types of roads can be simulated and represented by the printed indicia 120.

FIG. 3A shows the elongated tape in the form of a two lane road 130. The road 130 has a first side line 132, an opposite second side line 134, and a center line 135, with a portion 136 between the lines 132, 134, 135 being visually distinguishable therefrom. For example, the portion 136 can have a black color and the lines 132, 134, 135 can be white. To form an intersection, two or more segments of the road 130 intersect one another. Multiple road segments 130 can be combined to form a city block.

FIG. 3B shows a multi-lane highway 140 that is constructed by combining a plurality of separate individual playscape tape segments. For example, a single roll of playscape tape that represents a single lane is laid adjacent to and slightly overlapping another similar road segment (playscape tape segment) such that the road's right side line aligned with what will be the midline of the multilane road. The far right lane and the far left lane are the same except that their direction is opposite so the solid line is on the proper side of the road. In this way, an arbitrarily wide tape road is created, with as many lanes as desired.

The highway 140 of FIG. 3B is formed of a first playscape tape 142, a second playscape tape 144 and a third playscape tape 146 that are arranged in the preceding manner to form a three lane highway. The side lines of the second playscape tape 144 (which comprises the center lane) are not visible since the respective side edges of the other two playscape tapes 142, 144 cover such sides lines of the second playscape tape 144.

FIG. 3C shows a two lane road 150 that is constructed by combining two single-lane road segments 152*a* and 152*b*, each differently printed. The two segments 152*a* and 152*b* are lined up precisely one next to the other, going in opposite directions. The seam between the two road segments 152*a* and 152*b* is shown at 154.

Figure 4:
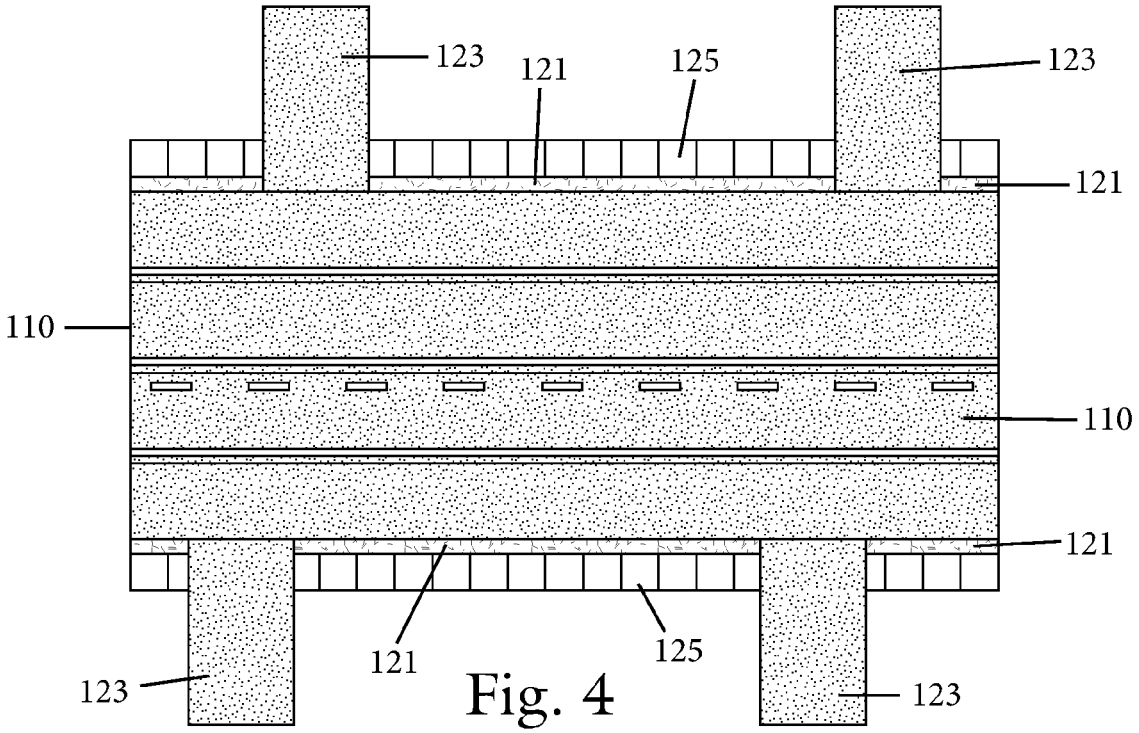
FIG. 4 is a top plan view of portion of a playscape play surface having an alternative appearance constructed according to another embodiment of the present invention utilizing multiple playscape tape segments with varying indicia.

As mentioned herein, the printed indicia 120 on the upper surface of the tape can vary from different road related indicia to nature related indicia (e.g., water or land). For example, the printed indicia 120 can simulate a dirt road, a metal bridge, a body of water (e.g., river), etc. FIG. 4 shows grassy areas 121, driveways 123 and sidewalks 125. In FIG. 3*c*, the road segment 152*b* is formed of a single lane and includes a broken line indicating a "passing zone" and road segment 152*a* is formed of a single lane and includes a solid line indicating a "no passing zone".

Based on the foregoing, exemplary printed indicia 120 include but are not limited to: paved roads, dirt roads, apocalyptic lava road, stream, river, brook/creek, sidewalk, bike path, canal, grass right-of-way, row of trees, airport runway, bridge, tunnel, subway tunnel, train track, jet stream, snowmobile path, hiking path, row of telephone poles, row of houses, row of street lights, fence (any type), snow/ice covered road, racetrack, golf course path, gravel road, cobblestone road, brick road, guardrails, etc. In yet another embodiment, the printed indicia 120 can have a non-transportation theme and in particular, the printed indicia 120 can simulate the following themes and can provide an educational and learning opportunity:

| | | |
|---|---|---|
| Bloodstream | Plant Capillaries | Computer circuitry |
| Computer networks | Building walls | |

It will also be appreciated that the composition and design of the playscape tape 110 can provide different effects including but not limited to the following: (a) glow-in-the-dark playscape tape for nighttime driving adventures; (b) playscape tape with unique glossy, glittery, sparkly, silvery, camouflage, gold or other cosmetic look that can add perceived value or make it more appropriate to a particular application; (c) playscape tape that has scalloped or otherwise not-straight edges for creative designs; (d) textured playscape tape; (e) blacklight-sensitive playscape tape; (f) blank playscape tape with a writing implement (crayon/marker) friendly surface so that a user can create their own designs on the playscape tape; (f) narrower, thinner playscape tape for use in confined spaces or for constructing smaller scale playscapes; (g) small rolls of playscape tape, both in length and core-size so the user can easily fit it into a pocket for on-the-go play; (h) playscape tape embedded with wire for follow-the-wire vehicles; (i) playscape tape with a contrasting black line imprinted on it for follow-the-line robot vehicles; (j) playscape tape with embedded radio frequency identification (RFID) playscape tapes for triggered events like turning a vehicle or making a sound or initiating a servo motor for a railroad crossing, etc., (k) perforated or small rolls of playscape tape that enable easy dispensing of a pre-defined length of playscape tape—examples include creating a runway, which has a definitive beginning and end but does not fit well on a sticker sheet; (l) playscape tape with length-wise repeating patterns for the development of board games or branded tape for corporate, education, sports team, or use as a promotional item by an affinity group; (m) playscape tape for outdoor play which includes a modified adhesive (stickier) or modified underside to support sidewalks and driveways; and (n) professional playscape tape for the remote control car enthusiast market, etc.

Figure 5:
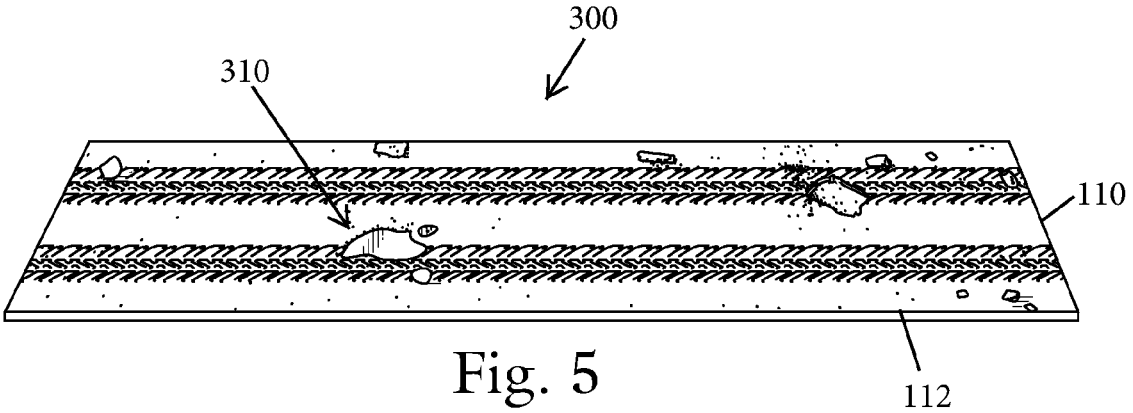
FIG. 5 is a perspective view of a segment of playscape tape that includes a topographical surface feature.

FIG. 5 shows a playscape tape 300 that has a surface modifying feature 310 that imparts a three dimensional aspect to the playscape tape 300 for simulating different road conditions or surface conditions. The illustrated surface modifying feature 310 is in the form of an uneven upper playing surface 112 of the tape 110. For example, in the case of a dirt or muddy road, the upper surface 112 is not smooth as in a paved road and therefore, the surface modifying feature 310 imparts the uneven nature of the upper surface. The surface modifying feature 310 can thus impart both raised (elevated) features, such as bumps, and recessed features, such as potholes or ruts, thereby creating a rough surface over which the toy (car) can travel. The raised feature can be any number of different features including railroad ties, rumble strips, sidewalk indentations, etc.

The surface modifying feature 310 can be formed using any number of different materials that impart the uneven surface to the tape 110. For example, a polymeric material can be applied to the base playscape tape (which can be formed of a paper material) to create the uneven surface. The surface modifying feature 310 is preferably integral to the tape 110 in that the feature 310 is not intended to be easily separable from the underlying tape 110.

Figure 6:
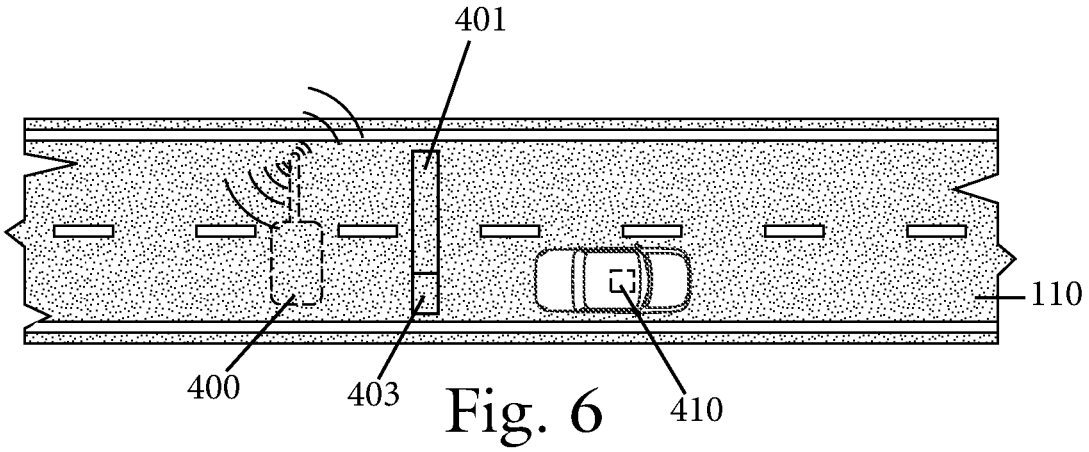
FIG. 6 is a top plan view of a sensor-based system implemented in the playscape tape and an accessory and formed of first and second sensor components.

Now referring to FIG. 6 in which a sensor based system is illustrated and more particularly, the playscape tape 110 includes a first sensor component 400 and an accessory includes a second sensor component 410. Alternatively, the first sensor component 400 can be associated with another accessory. In one embodiment, when the first and second sensor components 400, 410 are placed in proximity to one another, an event occurs and/or an operation is performed. For example, the first sensor component 400 can be a transmitter and the second sensor component 410 can be a reader that is disposed in a movable accessory such as a toy vehicle. The transmitter 400 can be embedded in the playscape tape and when the toy vehicle comes into close proximity as by driving along the road surface, the reader 410 in the toy vehicle detects the signal from the transmitter and the toy vehicle includes a processor that is in communication with the reader. Upon receiving the signal from the reader 410, the processor is programmed to perform an operation. It will be appreciated that any number of different operations can be performed including but not limited to illumination of a light in the toy vehicle, emission of a sound (such as a horn).

Alternatively, the opposite can be true in that the toy vehicle can include the transmitter 400 and the playscape tape 110 or other accessory (such as a sign or traffic light sticker 200 as in FIG. 7) includes the reader 410. Therefore, when the toy vehicle drives along the road surface, the transmitter 400 emits a signal that is detected by the reader 410 when the toy vehicle is in close proximity to the reader 410 and this causes an operation to be performed. For example, as the toy vehicle drives by a section of road (playscape tape) that includes the reader 410 and/or drives by a sign that includes the reader 410, the operation that is performed can be in the form of a light being illuminated in the road surface or sign or a sound being emitted, etc. It will be appreciated that other types of operations can be performed.

In one embodiment, the playscape tape 110 includes a first section 401 that includes at least one of a light source and speaker 403 which is visible or can be heard through the playscape tape 110 when illuminated or when sound is emitted, respectively. The first section 401 of the playscape tape 110 may be formed of a different material relative to surrounding sections of the playscape tape 110 or the first section 401 has different dimensions relative to the surrounds sections to allow the light source to be visible and/or allow the emitted sound to be heard. The light source/ speaker 403 is constructed and is of such a type that the playscape 110 can be wound about a tape core.

Any number of different types of signal technology can be employed in the above scheme including but not limited to RFID, conductive sensors, magnetic sensors, etc. In each of these technologies, the reader senses a signal or other type of emission of the transmitter (sensor).

FIG. 7 illustrates another aspect of the present invention in that the sticker 225 can be configured to allow for the construction of non-linear road abutting linear playscape tape segments 110. More specifically, the printed indicia on the sticker can be in the form of an intersection, a curved road segment, etc. FIG. 7 shows the use of a sticker sheet 201 that has a sticker 225 on it with printed indicia in the form of a curved road segment that is used in combination with two linear road playscape tape segments 110. In use, the sticker 225 would be removed from the sticker sheet 201 and aligned in combination with the two linear playscape tape segments 110 as shown in FIG. 7. Since the linear playscape tape is not particularly meant to be bent to impart curves in the road, the illustrated sticker allows for the easy implementation of a curve along the road surface. The user simply aligned one end 119 of one playscape tape segment 110 with one end 227 of the curved road segment 225 and the user aligns one end 119 of the other playscape tape segment 110 with the other end 229 of the curved road segment 225. It can be appreciated that the non-linear road component stickers can be die-cut to any curve angle (e.g., an S-curve, a hairpin turn, or less sharp curve as illustrated in FIG. 7) or other non-linear configuration (e.g., a fork in the road or an intersection as illustrated by 209 in FIG. 1 and FIG. 2). FIG. 7 also shows the use of an oil slick 211 along the curved road segment 225 (printed indicia on the sticker).

FIGS. 8A-8D illustrate yet another aspect of the present invention. The playscape tape 110 is typically distributed as part of an overall product/packaging which is generally indicated at 500 in FIG. 8B and includes the playscape tape 110 as a component thereof. More specifically, a tape roll core 510 is used to contain the playscape tape 110. For example, the playscape tape 110 is typically rolled about a tape roll core 510 which is a solid structure that can be formed of cardboard or a plastic inner ring. In accordance with the present invention, the tape roll core 510 is part of the toy and can be used as a play accessory so that no part of the product is wasted once the playscape tape 110 is unwound off the tape roll core. The tape roll core 510 includes an outer surface 512 on which printed indicia 520 is formed. The printed indicia 520 is thus located underneath (beneath) the wound playscape tape 110. The printed indicia 520 can take any number of different forms and depict any number of objects, settings, landscapes, etc. For example, the printed indicia 520 can depict the exterior of a building, a set of buildings, building floor, or set of floors or some other design relevant to the design on the roll of the playscape tape 110.

In another embodiment, the printed indicia 520 on the outer surface of the tape core roll simulates a wheel or tire and further, the printed indicia 520 on the outer surface of the tape core roll simulates the circumference surface of a wheel or tire. Packaging for the tape core roll can include a lid includes at least one lid that is configured to seat along one side of the core and has at least one of printed indicia and a shape that simulates a hubcap or wheel and spokes.

One end of the elongated playscape tape 110 is detachably attached to the core 510 in such a way that the detachment of the elongated playscape tape 110 does not mar the printed surface 520 formed on the outer surface 512.

Figure 8C:
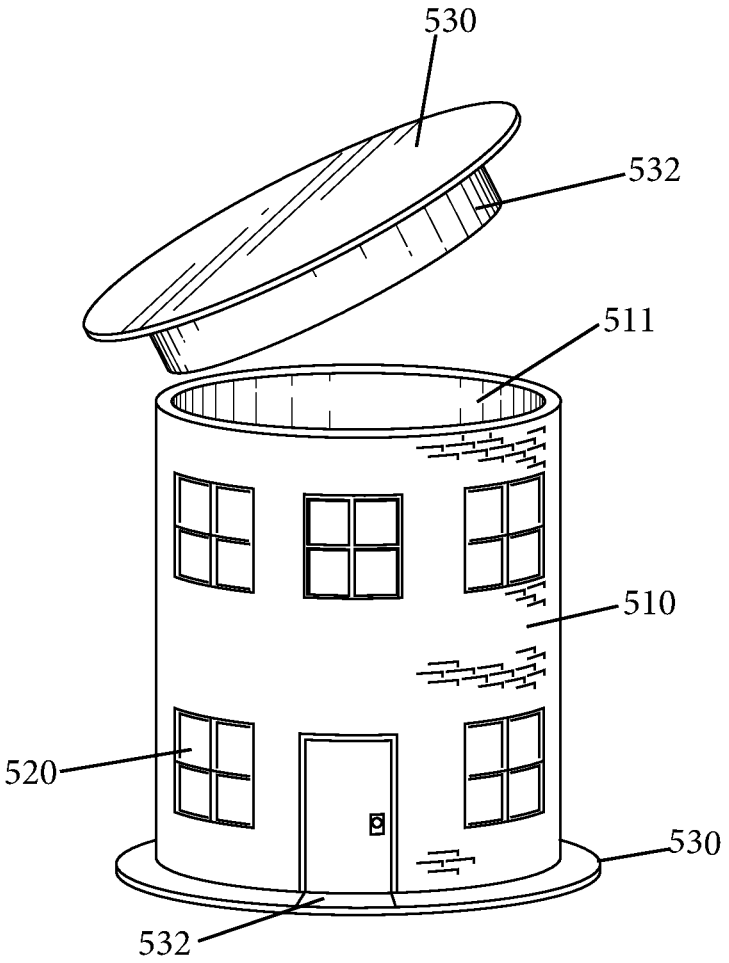
FIG. 8C is an exploded perspective view of the tape roll core with a cover being shown removed therefrom.

The tape roll core 510 is hollow as shown in FIG. 8C. The interior hollow space within the tape roll core 510 can be used for storage of accessories, such as a toy car, signs, stickers, that can be at least initially stored in this location at the point of purchase. FIG. 8D shows two tape roll cores 510 stacked.

In FIGS. 8A-8D, the printed indicia 520 is in the form of a building exterior and thus, depicts a brick building with a door and windows. The tape roll core 510 can be designed to be stackable as for example, the illustrated cylinder can be stacked on top of another cylindrical shaped tape roll core 510. For example, two tape roll cores 510 can be stacked to form a taller structure. In addition and optionally, the packaging including the tape roll core 510 can come with a cover (end lid) 530 that can serve as a roof of the building created by one or more tape roll cores 510 that include the printed indicia 520.

Other playscape tape rolls can offer a blank exterior (i.e., a blank outer surface 512) and a writing implement (e.g., marker or crayon) that can be used with the blank exterior which is both a crayon and marker-friendly surface to allow a child to create his or her own design. The tape roll core 510 and optionally the lid 530 add a third dimension to the playscape 100 and enable the user to build up a collection of reconfigurable buildings for enhancing any playscape, as illustrated in FIG. 1.

The tape roll core 510 can have a shape other than a cylinder and in particular, the tape roll core 510 can have a square or rectangle shape. Regardless of the shape, the tape roll cores 510 can be interlocked and stacked and the cover (lid) 530 can be placed on the stacked structure. In this way, the user (child) can create an entire city, with buildings and roads, out of playscape tape 110 and its built-in accessories. The lid 530 can vary in design to simulate any "top" feature, like different roof styles, etc.

FIG. 8C illustrates that the lid 530 can include a flange (a peripheral flange) 532 that is sized to be received within an opening 511 of the tape core roll 510. In other words, the outer diameter of the flange 532 is slightly less than the diameter of the opening 511 to allow reception of the flange 532 therein and preferably effectuate a frictional fit between the lid 530 and the roll 510. As mentioned herein, the lid 530 can include indicia that emulates a roof of a building or graphically depicts some other object. FIG. 8C also shows that two lids 530 can be used, one simulating the roof, the other simulating a foundation of the building. In addition, the second lid that simulates (emulates) the foundation can include printed indicia 535 such a bricks, a doorway entrance, etc. to provide a more realistic accessory.

The end section of the playscape tape 110 that is wound intimately about the outer surface 512 is preferably attached to the outer surface 512 in such a manner that the removal of this end section from the core roll 510 does not damage and mar the indicia 520 formed on the outer surface 512. For example, the end section of the tape 110 can be attached using an adhesive that does not mar the outer surface 512 when the end section is pulled off of the tape 110.

In another aspect of the present invention, a kit can be provided which includes not only the playscape tape 110 but also other accessories, such as toy vehicles 20, stickers 200, three-dimensional objects, etc. Such a kit also naturally includes the tape roll cores 500 associated with each included roll of playscape tape 110, and optionally associated lids 530. It will be appreciated that different types of playscape tapes 110 (e.g., ones with different play surfaces (e.g., one lane vs. two lanes)) can be part of the kit. This allows the user to customize the playscape, utilizing different road surfaces as part of the playscape. The kit can include playscape tapes that have simulated road surfaces formed thereon and can include playscape tapes that have simulated natural surfaces formed thereon. The natural surfaces can be dirt surfaces, rock surfaces, grass surfaces, etc. A child can thus use the different components of the kit to create a vivid realistic playscape that is easily customizable and dynamic but at the same time does not mar floors, tables, or other support surfaces.

Construction System for Creating a Customizable Play Surface Composed of Printed Adhesive Tape and Other Accessories for Autonomously Controlled Mobile Agents Now turning to FIGS. 9-14, the present invention provides for a construction system for creating a customizable play surface for mobile agents that provides a more realistic racing and driving experience where the track itself is inexpensive, more flexibly constructed for a more varied play experience, securely attached to the surface on which it is laid, and easily stored and transported, and even discarded and recycled.

Track Construction System

Figure 9:
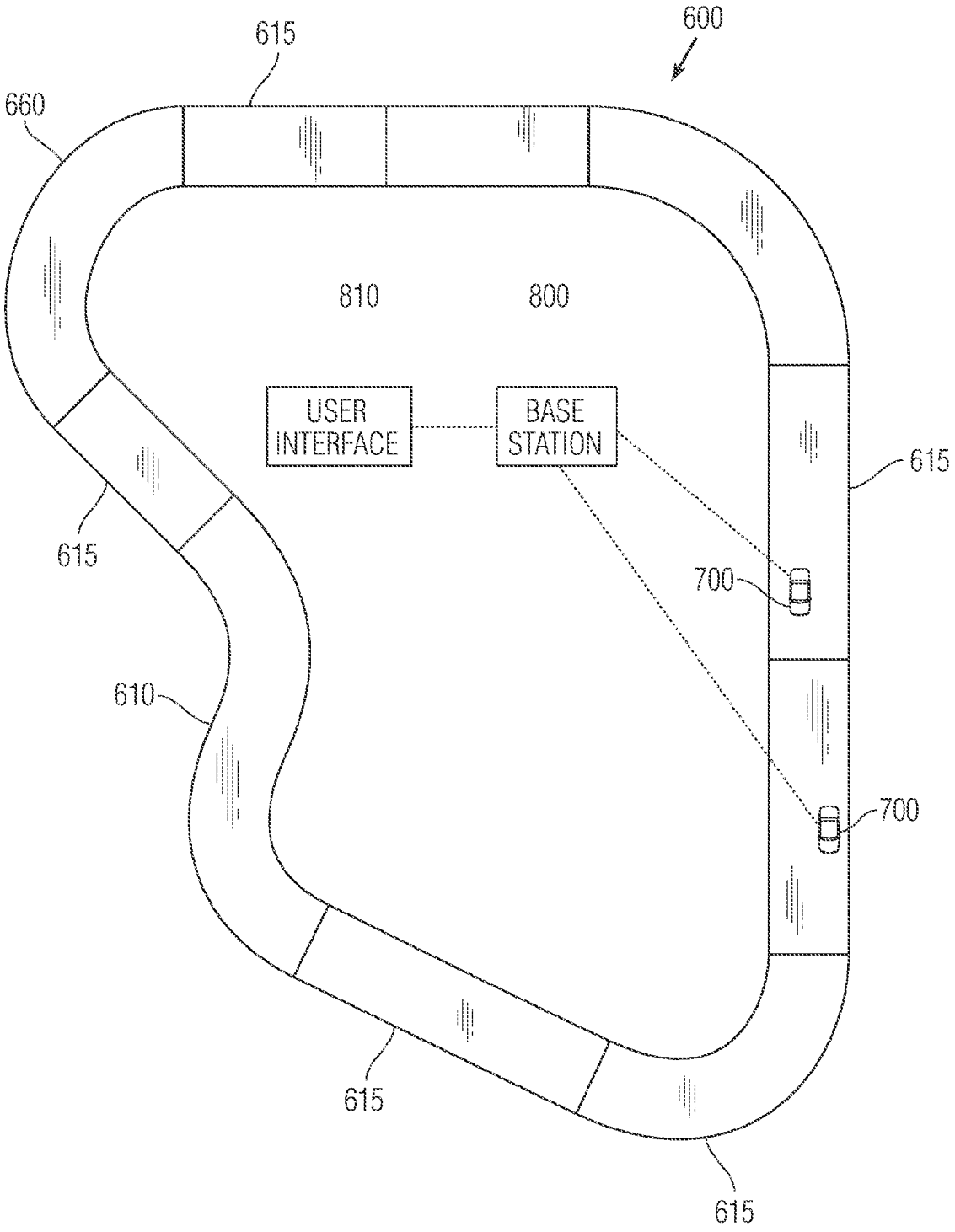
FIG. 9 is a top plan view of an exemplary track construction.

As will be appreciated in view of FIG. 9, a track construction system 600 in accordance with one embodiment of the present invention includes a number of individual components that work together and in particular, can be formed of: (1) a drivable surface 610 which is a physical surface on which a user controlled vehicle (mobile agent) drives and can also include other accessories, such as stop signs, traffic lights, traffic signs, road markings, etc.; (2) mobile agents 700 which can be in the form of vehicles that are configured to independently move based on user received commands and in particular, each vehicle 700 can include one or more sensors that can read information from the drivable surface 610 and a communication module that is configured to send and receive commands from a base station 800; (3) base station 800 which is typically in the form of a separate software controlled computer. Under the control of its software, the base station 800 maintains the state of the vehicles and other agents and sends and receives commands to and from the mobile agents 700 and other accessories that may be a part of the system; and (4) a user interface 810 which includes all the hardware and software needed for a human user to interact with the system and control the mobile agent (vehicle) 700 along the drivable surface 610.

As mentioned above, the vehicle 700 drives along the surface 610 that is formed of individual track segments 615. The individual track segments 615 connect to one another at specific connection points using fasteners or some other type of mechanical connection, such as a click-in connection, or reversible bonding technique. For example, each track segment 615 can have one or more fasteners, such as pins, magnets, etc., that mate with fasteners of the other track segment 615 to allow the connection between the track segments 615. Since the connection between the track segments 615 can be undone, the user can easily reconfigure and customize the layout of the surface 610. Each track segment 615 has an associated length and shape. For example, some track segments 615 are linear in nature, while others have curvature including simple curvature or complex curvature. Also, some track segments 615 can be longer in length, while others can be shorter.

As described herein before, in certain embodiments, the entire track segment can be formed of a rollable, cuttable tape material—playscape tape—and therefore, the formation of a track construction in these embodiments entails placing the cut tape track segments in an abutting or partially overlapped manner with respect to one another so as to form a continuous track construction.

It will also be appreciated that in some embodiment, the track segment 615 can include a power line (e.g., a wire) that is carried by the track segment and can be used to power one or more accessories, such as an illuminated sign or light, that is positioned adjacent to one track segment 615. A power source, such as a battery or the like, can be operatively connected to the power line for powering of any accessories that are connected to one or more of the track segments.

Figure 10:
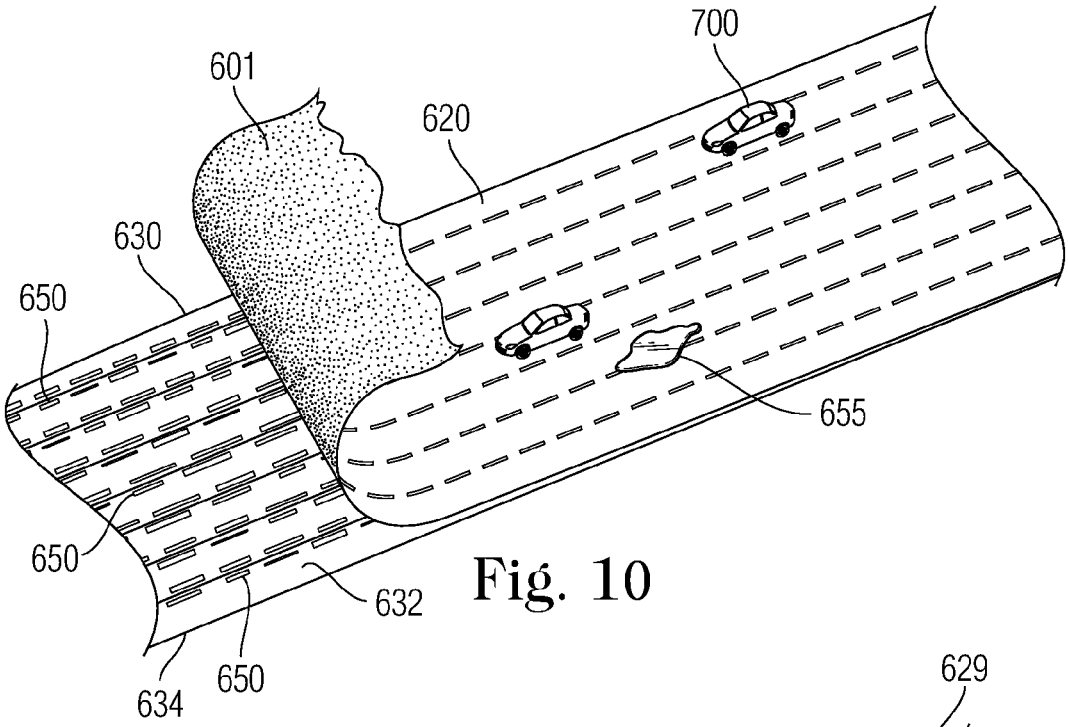
FIG. 10 is a perspective view of a segment of a track construction with a top layer being partially unrolled to show a bottom layer thereof that contains machine-readable codes.
Figure 11:
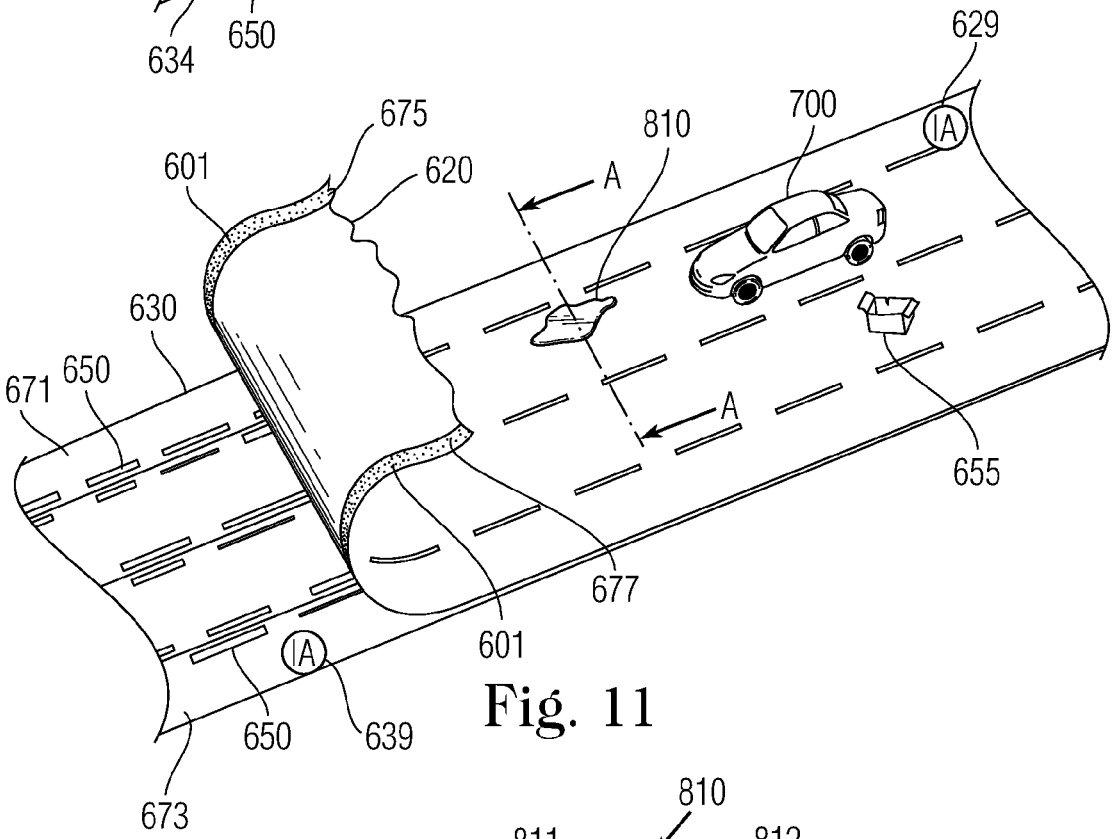
FIG. 11 is a perspective view of a segment of an alternative track with a top layer being partially unrolled to show a bottom layer thereof that contains machine-readable codes.

FIGS. 10 and 11 illustrate an exemplary track construction 600. The bottom track layer 630 has a first surface 632 that faces the top layer 620 and an opposite second surface 634 that faces a support surface which supports the track construction 600. The top and bottom layers 620, 630 can be formed of different materials with at least one of the layers 620, 630 being formed of the adhesive playscape tape described herein. The different types of track constructions are discussed below.

Now referring to FIGS. 10-13, each track segment 615 includes a plurality of machine-readable codes (readable markings) 650 that are explained herein but generally allows each vehicle 700 to identify its position on the track segments 615 as the vehicle drives thereover. It will be understood that while the machine-readable codes 650 are shown in the drawings as being black markings on a white background, this is for readability and instead, the machine-readable codes 650 can be formed in any number of different colors and can also be formed so as to be invisible to the human eye. For example, the machine-readable codes 650 can be in the form of IR readable codes.

In one embodiment, these machine-readable codes 650 can encode information, such as the identity of the type of track segment 615 the vehicle 700 is currently driving on (e.g., straight, intersection, curved, etc.), unique locations on that particular track segment 615, and a line (centerline) 616 to suggest an optimal position for the vehicle 700 if it desires to stay within its lane. While line 616 can be referred to as a centerline, the vehicle 700 is in no way required or constrained to follow this particular line 616. In the example shown in FIG. 12, one centerline 616 appears at the center of the drivable lane to allow the vehicle 700 to steer within that lane. Periodically along one or both sides of centerline 700 are a series of rows of markings 617 that encode the piece ID (e.g., right of centerline 616) and the unique location 619 (e.g., left of the centerline 616) identifications (IDs) throughout the lane. While rows of markings are described herein, any suitable and/or desirable set of markings (arranged in one or more rows or some other configuration(s)) capable of performing the same function as the rows of markings described herein can be utilized. These identifications can include varying-thickness bars where each encodes a unique value. While in the examples discussed herein, each bar is either thin or thick representing a 0 or 1 in a binary encoding of information, respectively, the number of unique bar thicknesses can be variable and depend primarily on the accuracy and resolution of an imaging system of the vehicle 700. Depending on the number of unique piece or location IDs, each ID is encoded over one or more consecutive rows of markings. A single thicker bar 621, herein a "stop-bar" can replace all bars on either side of centerline 616 to mark the completion of each piece or location ID. It is desirable to have a buffer of space between the extremes of the road markings and the boundaries of the total viewable area of the vehicle imaging system to allow for translational errors that might naturally occur during driving.

Figure 13:
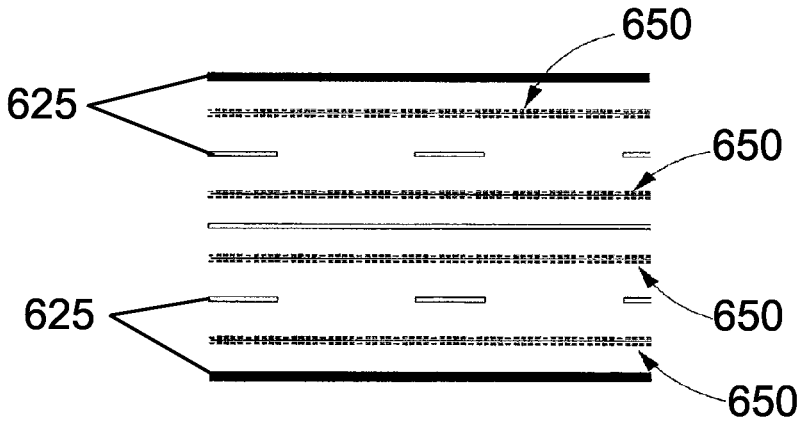
FIG. 13 is a multi-lane track segment showing exemplary markings.

Additional information concerning the use of machine-readable codes is set forth in the '177 patent. FIG. 13 shows codes 650 in a multi-lane road and printable indicia 625 on the top surface.

In accordance with the present invention, the surface 610 is thus constructed to allow for any type of mobile agent 700 to travel along the track by communication from a controller (base station 800) to the vehicle 700 itself. This control allows for the mobile agent 700 to accelerate, decelerate, turn, or avoid a lane marking or other obstacle.

In one aspect of the present invention, a physical method of building a two-layer track surface 610 for autonomously controlled mobile agents 700, partially controlled mobile agents and radio or remote controlled vehicles is provided. Each track segment 615 is constructed by combining a two-layer system defined by a bottom track layer 630 and a top track layer 620, with the bottom track layer 630 containing the machine-readable codes 650 which the specific mobile agents 700 created for this type of system can be used. As mentioned, these specific mobile agents 700 contain one or more sensors, such as an infrared (IR) sensor in order to read the underlying codes 650 beneath them. The construction of this two-layer track system (surface 610) allows vehicles 700 (or any other mobile agent such as a truck, train, off-road vehicle or robot) with infrared sensing to drive and move seamlessly on the track surface 610.

The user can easily setup and build the track 600 in an open area. The manner in which the track 600 is built and disassembled depends upon the construction of the track segments 615. More specifically, when the track segment 615 is formed at least in part with a rigid material (as is the case when the adhesive playscape tape is only used as the top layer of the track segment and the bottom layer is a non-tape layer), the individual track segments 615 can be detached from one another and then stored in a box or the like. When, the track 600 is formed of a tape material (as when the bottom layer is formed of the adhesive playscape tape), the track 600 can be removed from the support surface and even discarded after use. The different constructions for the track segments 615 are described in more detail herein.

Top and Bottom Layers Formed of Tape

In accordance with one embodiment of the present invention, the bottom and top layers 630,620 can both be made of playscape tape with the bottom track layer 630 having adhesive material 601 on the bottom thereof so that the track 600 can be stuck to any surface for play. This paper adhesive product is presented to the user in a rolled up format with a core so that the user can have mobility of the track 600 and have it take up minimal storage space. The track 600 can now be assembled anywhere and is portable for travel. In addition, when play is complete, the storage issue of the present invention is removed as the track 600 can be rolled back up (when the top layer contains adhesive, while the bottom does not) or even discarded as it is made of paper. The adhesive will allow use on many different surfaces with no harm to the underlying material (tile, wood, paint).

Top Layer Formed of Tape

In one embodiment, the top visual layer 620 of the two-layer construction has adhesive 601 on its underside which allows it to be properly attached to bottom layer 630. This will allow the two layers 620, 630 to fuse together properly so that the user is unaware that there are two layers 620, 630 and the track construction 600 presents itself as one piece of paper and one track. The fusing of the two layers 620, 630 can be performed using traditional techniques including the use of bonding/adhesive agents, mechanical fasteners, laminating, or a combination thereof, etc.

Unlike the conventional track constructions mentioned above, the track construction 600 of the present invention and in particular, the track segments 615 thereof, are easily rollable and can thus be provided in a rollable form (i.e., rolled about a core). This provides a number of advantages over the traditional track system that are in the form of large rigid track sections that occupy a sizeable amount of space and are stored in a box or the like. By being in a rollable form, the track construction 610 occupies much less space and is easily transportable.

Also unlike conventional track constructions mentioned above, the track construction 600 of the present invention is made of paper tape and thus may be torn or cut to any length and is a consumable product that may be discarded or recycled after use.

The top layer 620 can take many different forms and can include any number of different graphics that depict different information, such as road signs, hazards (e.g., potholes, cracks, uneven surfaces), weather (snow, puddles, mud, etc.), etc. The information/graphics depicted on the top layer 620 can be printed or otherwise directly formed on the top layer 620 or can be applied to the top layer 620 as in the case of a sticker or the like which is applied to the top layer 620.

It will therefore be appreciated that when the top layer 620 is formed of tape, the user can readily alter the appearance of the track by switching the top layer 620. Since the top layer 620 is securely attached to the bottom layer 630 by the adhesive 601 on the underside of the top layer 620, the top layer 620 can be peeled off of the bottom layer 630 and then can be replaced with another top layer 620. This allows the visual appearance of the top layer 620 to be easily altered. While the codes 650 are not changed when switching the top layer 620, the appearance of the top layer 620 can still be altered and configured to work with the existing codes 650 that are provided on the bottom layer 630.

Top Layer Only Formed of Tape

It will be appreciated that the bottom track layer 630 can be a non-tape layer and thus does not include an adhesive on the underside thereof. When the track segment 615 has this construction, the bottom layer 630 can be formed of a rigid or semi-rigid material or a flexible non-tape material. The bottom layer 630 can even have the same or similar construction as in the Anki product that is discussed hereinbefore. The playscape tape that forms the top layer is thus strategically laid over and adhesively bonded to the bottom layer 630 to form the track segment 615.

Bottom Layer Formed of Tape

It will therefore be appreciated that in accordance with the present invention, playscape tape, as described herein, can be used for one or both of the bottom layer 630 and the top layer 620. For example, playscape tape can be used as the bottom layer 630 and include the codes 650 formed therealong. The codes 650 can be formed using any of the techniques disclosed herein.

The bottom surface of the bottom layer 630 includes adhesive 601 that allows the bottom layer 630 to be adhered to a support surface, such as a ground surface. This allows the track construction 600 to be applied to many different types of surfaces and provides an advantage over the existing track construction which does not have such adhesive properties.

Coding System

A coding system can be generated for matching a coded bottom layer 630 with one or more suitable top layers 620.

For example, a type "A1" bottom layer 630 can work with any top layer 620 that is classified as being of type "A1". In this manner, a set of type "A1" top layers 620 can be provided for combination with the type "A1" bottom layer 630. The coding can be in the form of small markings 629, 639 (FIG. 11) or the like that are placed on the respective layers 620, 630. In this way, the user can easily match respective top and bottom layers 620, 630. The top layers 620 that are not in use can be stored for future use as by being stored as part of a tape roll. The user can thus unroll an additional tape segment that is for placement on the bottom layer 630.

Additional markings can be provided on the tape (which forms one or both of layers 620, 630) to differentiate being adjacent top layer segments. For example, one marking can be in the form of a cut or tear line to identify a location at which the tape is to be torn or cut to segment the top layer segments.

Machine-Readable Codes on Bottom Layer

In each embodiment described herein, the bottom layer 630 is constructed with the machine-readable codes 650 that are provided along a surface of the bottom layer 630 and can be designed directly on the bottom layer 630. The bottom layer 630 can thus be formed to have any number of different constructions given the vast number of different constructions of the readable codes 650 on the bottom layer 630. As mentioned herein, the machine-readable codes 650 can be invisible to the human eye.

The machine-readable codes 650 can provide for tracks that allow just for straight racing with no obstacles at all, but rather a focus on speed, while other design tracks allow for obstacle and agility driving. On these obstacle tracks, the codes 650 on the bottom layer 630 of the two-layer track segment 615 contain assignments to the mobile agent 700 that will be read through infrared sensors on the mobile agent 700. The mobile agent can be configured to turn, adjust speed and swerve as designed and directed by the codes 650 on the bottom layer 630. On the top layer 620, these various obstacles 655 may be indicated with drawings of common items a car may encounter on a real road that would cause it to swerve.

The graphics for these obstacles 655 can be printed directly onto the top layer 620 and can include things like: oil slicks (shown), snow or water puddles, garbage that has fallen off a truck, potholes or speed bumps, etc. Alternatively, as described herein, the obstacle can be in the form of a sticker.

In any of the displays and methods used to build these track systems 600, the play adhesive track material will also form curve and intersection stickers 660 (FIG. 9). These stickers 660 can be added to any track that the user builds and will contain the necessary two-layer system so that within the curve or intersection, coding 650 is provided on the bottom layer 630. The curves are created in different sizes and effectiveness so that some may be slight in nature allowing a mobile agent to continue its speed from a straight portion of the track onto the slight curve, while other curves may be sharp or longer in nature causing a mobile agent to have to proceed with caution. The curves can be attached by the user to any point in the track as they will match the current top layer 620 in scale, color and effect.

The track construction 600 thus provides a surface having a plurality of machine-readable codes indicating locations on the surface. As mentioned herein, each self-propelled mobile agent 700 (e.g., vehicle) includes a sensor configured to detect the machine-readable codes 650 as the mobile agent 700 travels along the surface 610. Thus, as the mobile agent 700 travels along the surface 610, the mobile agent 700 detects at least one machine-readable code 650 via the sensor of the mobile agent 700 and the mobile agent 700 is responsive to the detected machine-readable code 650. The mobile agent 700 is configured to wirelessly transmit data regarding the detected code to the base station 800 for use at the base station 800 in determining a location of the mobile agent 700 in a virtual representation. The transmitted data is also used at the base station 800 in determining a specific action to be taken by the mobile agent 700 based on the data regarding the detected code 650. The mobile agent 700 can wirelessly receive from the base station 800 at least one signal to specify the specific action to be taken by the mobile agent 700 on the surface in a manner whereupon the mobile agent moves in a coordinated manner on the surface 610.

In one embodiment, the machine-readable codes 650 comprise optically readable codes (IR codes) and therefore, the top layer is constructed so as to allow the optically readable codes to be read through the top layer. The top layer 620 thus has a thickness that allows for such sensing of the codes and is formed of an optically transmissive material (e.g., IR transparent material). The machine-readable codes 650 can thus define at least one path of travel of the surface and encode locations on the surface.

The manner in which two adjacent track segments 615 are attached has been discussed hereinbefore.

Alternative Constructions

As shown in FIG. 11, in one embodiment, the bottom layer 630 has a first side edge surface 671 and an opposing second side edge surface 673 on which the top layer 620 seats. In particular, the first and second side edge surfaces 671, 673 can be slightly recessed relative to the center of the bottom layer 630 and define platforms on which the top layer 620 seats. Since the top layer 620 covers the machine-readable codes 650, the top layer 620 can be carefully configured such that a center portion of the top layer 620 that covers the machine-readable codes 650 does not include adhesive material 601 and therefore, the machine-readable codes 650 are not marred. Instead, the two side edges 675, 677 of the top layer 620 include adhesive 601 and therefore, the adhesive side edges 675, 677 of the top layer 620 seat against the first and second side edge surfaces 671, 673 to cause the joining of the top and bottom layers 620, 630. Since the adhesive portions 675, 677 of the top layer 620 do not contact the machine-readable codes 650, the top layer 620 does not mar these codes 650 and can be easily peeled away from the bottom layer 630 to allow replacement of the top layer 620. As mentioned herein, the top layer 620 may be replaced in order to change to appearance of the track 610 or otherwise alter play.

It will be appreciated that the use of playscape tape as defining the top layer 620 and/or the bottom player 630 allows for a great degree of customization and alteration of the track construction post purchase. As mentioned herein, unlike the fixed top layer of the conventional product, the top layer 620 of the present invention can be laid down and adhered to the bottom layer 630. Further, accessories, such as stickers, allow for the surface of the top layer to be altered and customized further.

In addition, it will be appreciated that the playscape tape can include glow-in-the-dark ink on its printed surface for allow for visibility in the dark and/or the ink applied to the tape is blacklight-sensitive.

It will therefore be appreciated that the playscape tape described for use as part of the track construction 600 is formed of a printable substrate material that allows for reading of the codes 650 (e.g., IR transmissible) by a sensor in the vehicle 700 and also carries the adhesive material 601. This substrate material is also rollable and can be provided about a core as described herein.

In the event that the system is configured to allow the user to switch the top layer 620 of the track 610, guides can be provided for aligning and affixing the top layer 620 to the bottom layer 630. In the simplest sense, the side edges of both the top layer 620 and the bottom layer 630 can be aligned to ensure the desired positioning of the top layer 620 relative to the bottom layer 630. Other alignment means can be provided to ensure that the top layer 620 aligns with the bottom layer 630. For example, visual markings can be provided to assist the user in laying the top layer 620 over the bottom layer 630. The visual marking can be formed on one or both of the layers 620, 630.

Responsiveness to Environmental Stimuli Placed on the Track

The present invention incorporates yet another level of play in that the track surface 610 contains relevant, real life environmental stimuli that alter the manner in which the game is played and/or the vehicle 700 behaves. For example and as described herein, one or more objects and/or markings can be placed on or be formed as part of the top layer 620 so as to increase the real life appearance of the track 610 and alter play. For example, printed material (such as a print layer) on the top layer 620 can improve the life-like appearance of the track 610 and/or can provide different hazards that test the skills of the player. Alternatively and/or additionally, the hazards can be in the form of stickers (e.g., 810) or the like that are placed on the top surface of the top layer 620. The sticker can have any of the printed indicia discussed herein including but not limited to a road hazard, such as a pothole, oil slick, large water puddle, debris in the road, etc. In this manner, the player must be responsive to environmental aspects of the track 610.

A sticker can act as a hazard since the sticker can be designed to block the vehicle from reading the underlying code 650 formed on the bottom layer 630. In the event that the vehicle 700 encounters a blocking sticker, control over the vehicle can be temporarily lost (thus penalizing the player) and/or the movement of the vehicle may be altered in that control over the vehicle is temporarily lost which can result in the vehicle spinning out and/or crashing, etc. In this manner, the sticker acts as a hazard that is to be avoided. To avoid the hazard, the player must skillfully turn the vehicle (e.g., changes lanes) to steer around the sticker.

The printed material can include guide markings for the placement of three-dimensional objects which act as hazards. The guide markings can be in the form of an outline on which the hazard is placed.

In the commercially available product, the machine-readable codes, in general, are used to transmit vehicle location data and track construction identification data to the base station. While the behavior of the mobile agent is somewhat influenced by this sensed information in that the wheels are turned to properly navigate an upcoming bend in the road, the mobile agent is only influenced by a physical property or characteristic of the track itself, such as whether the track segment is linear or curved and the length of the track segment or degree of curvature of the track segment, etc. These are all physical characteristics of the track segment and are not based on information that is displayed on the road as printed indicia. Thus, in contrast to the prior art, the present invention provides a track construction in which the behavior of the mobile agent is directly influenced by the printed indicia that is on the top layer of the track construction. As a result and as described in more detail below, the machine-readable codes of the present invention are expanded to include machine-readable codes that relate to printed indicia formed on the top layer.

It will be appreciated that unlike the commercially available track construction system, the present invention is configured so that there is a direct relationship between one or more regions of printed indicia presented on the top layer and one more of the underlying machine-readable codes. For example and as described herein, at least one discrete printed area that is part of the top layer has at least one machine-readable code formed as part of the underlying bottom layer such that the behavior of the mobile agent is influenced by the machine-readable code when the mobile agent is in close proximity to the printed indicia and/or travels over the printed indicia. For example, in the event, that the printed indicia represents a road hazard, such as an oil slick, the underlying machine-readable code is designed to cause the mobile-agent to react in a manner that simulates the behavior of a vehicle when driving across an oil slick. Thus, the machine-readable code can cause the mobile agent to react in a manner that simulates a slip and slide motion as one would experience when experiencing a slippery, slick material, such as oil. The behavior of the mobile agent can thus be immediately influenced by changing the direction of the wheels so as to cause the mobile agent to veer off the original course. Similar reactive behavior of the mobile agent can be experienced when the mobile agent encounters an obstacle in the form of an ice patch, loose gravel in the road, a pot hole, etc.

It will also be appreciated that the printed codes below the top layer can thus be designed to include and to relay more information to the base station from the mobile agent. More specifically, the machine-readable code can correspond to an area of printed indicia on or applied to the top layer and there is a purposeful relationship between the action that the mobile agent undertakes and the content of the printed indicia. For example, if the printed indicia relates to a hazard, the mobile agent's behavior will be influenced in an adverse manner, such as a reduction in speed and/or a turning action and in the event, that printed indicia relates to a traffic sign, the mobile agent reacts accordingly, such as if the sign is a caution side (e.g., Caution Smoke or Fog ahead) and the mobile agent reads the corresponding underlying codes, the mobile agent will lose speed and thus, be penalized for driving too close to or over the printed indicia bearing such caution sign.

Dynamic Alteration of Track Construction

Figure 14:
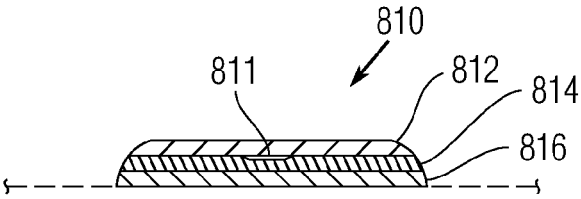
FIG. 14 is a cross-sectional view of a sticker according to one embodiment for use with a track segment.
Figure 12:
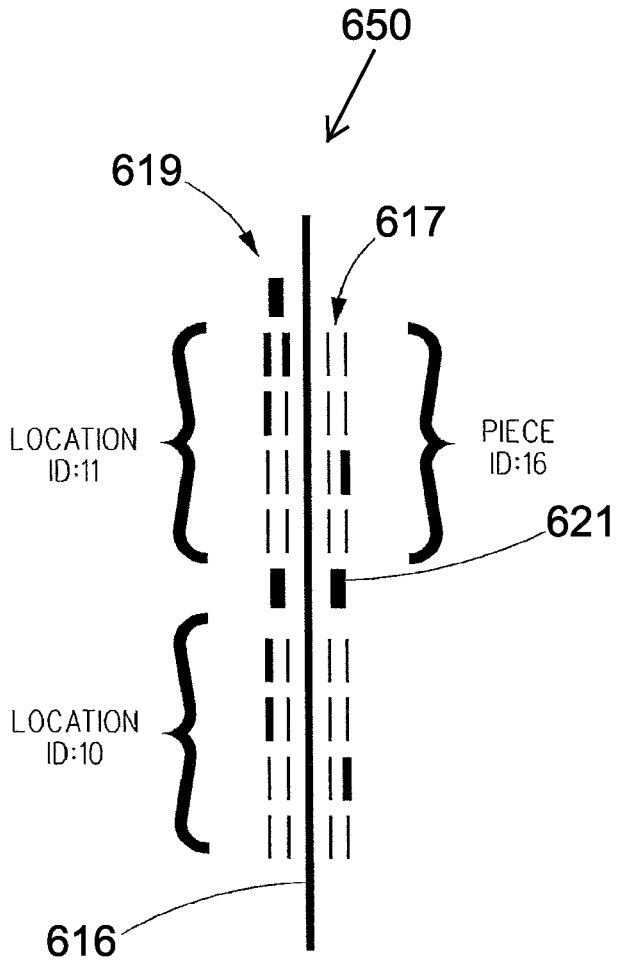
FIG. 12 sets forth exemplary markings that can be included on a track segment shown in FIGS. 10-11.

As shown in FIGS. 11 and 14, in another aspect of the present invention, the user can dynamically alter the machine-readable codes 650 that are formed as part of the bottom layer 630. More specifically, an accessory 810 can be provided for placement over the top layer 620 for altering the static code information 650 that is part of the bottom layer 630. More specifically, the accessory 810 has its own machine-readable code 811 that overrides the static code information 650 that lies below the accessory 810. The accessory 810 can thus be in the form of a sticker that can be placed over the top player 620 of the track 610. The sticker 810 is formed such that the machine-readable code 811 is readable by the vehicle 700; however, the underlying machine-readable code 650 is blocked from being read by the vehicle 700.

As shown in FIG. 14, the sticker 810 can be formed of at least two layers and in some embodiments, is formed of three layers. More specifically, the illustrated sticker 810 is formed of a first (topmost) layer 812, a second intermediate layer 814 and a third (bottommost) layer 816. The first layer 812 can be thought of as being a print layer since it includes the printed indicia that is visible. The second layer 814 can be thought of as being the layer that includes the machine-readable code 811 and therefore, the first layer 812 is formed so that the vehicle 700 can read the code 811. For example, when the code 811 is based on IR, the first layer 812 is IR transmissible. When provided, the third layer 816 can be thought of as being a blocking layer that ensures that the machine-readable code 650 that lies below the sticker 810 is not read by the vehicle 700 traveling in proximity to the sticker 810. In other words, the third layer 816 is an IR blocking layer that prevents IR waves from passing there-through. This ensures that the vehicle 700 cannot read the code 650 that lies below the sticker 810. The third layer 816 can thus be formed of an opaque material that blocks IR transmission.

In one embodiment, the sticker 810 can be randomly placed on the top layer 620 so as to alter the underlying machine-readable code 650 and provide a new machine-readable code 811 that controls the vehicle 700 upon sensing of the machine-readable code 811. In another embodiment, the track 610 can have select, identifiable locations on which one or more stickers 810 can be placed. By providing defined areas along the track 610 at which the sticker 810 can be placed, proper registration between the sticker 810 and the bottom layer 630 is ensured and in particular, the machine-readable code 811 is placed in registration with the underlying code 650 to ensure that the vehicle 700 properly reads the underlying code 650 as it approaches the sticker 810 and then reacts when the vehicle 700 travels over and reads the code 811 that is part of the sticker 810 and then finally, once the vehicle 700 passes the sticker 810, the vehicle 700 assumes reading of the underlying codes 650 (downstream of the sticker).

The software that is part of the vehicle 700 thus reads the code 811 and the vehicle 700 in turn alters its behavior. For example, in the event that the sticker 810 portrays a speed trap, the driver of the vehicle 700 that is caught in the speed trap (by navigating his/her vehicle 700 to close to or directly over the sticker 810) is penalized by having the vehicle 700 temporarily disabled in that, the propulsion of the vehicle 700 can be temporarily suspended to cause the vehicle 700 to slow down, etc. As mentioned before, the vehicle 700 can be forced to undertake other actions, such as an abrupt lane change, etc., when the vehicle sensor reads code 811.

Thus, as with the commercial product, the track segments 615 according to the present invention contain unique markings on each track segment (piece) 615 that identifies the type of the piece (track segment 615) and allows the vehicles 615 to determine their locations. In the case of the use of infrared based printed codes, as mentioned before, the human eye cannot see these markings; however, each vehicle 700 has an infrared camera that allows it to decode the information encoded in the markings. The vehicle 700 itself has a processor that runs software and this software is dedicated in large part to decoding the position of the vehicle and controlling basic driving behaviors of the vehicle 700.

The track construction 600 of the present invention fills two distinct needs for users. The play adhesive tape track material will allow companies who currently have readable codes to use a paper adhesive as their top layer of the track which lowers the cost of producing the current item as well as offers a much lower price to the end user. The present invention also allows for use of an autonomous two-layer play adhesive tape track system where both the upper and lower layer are made from paper tape. This allows the user to not only have an inexpensive option for mobile agents that use infrared detection to navigate a track, but allows the user to creatively design their own track which can also be rolled up after use, re-used and be taken with the user to another location or thrown away as it is made of paper and a new track or roll of tape can be used the next time the user wants to play with these vehicles.

The present invention allows for a product like the currently registered readable codes track for mobile agents to become more inexpensive by using paper adhesive tape as its top layer 620 for each track segment 615 and allows for much more creativity and design of the tracks 600 by containing actual road lines (e.g., yellow or white) as well as various graphics for obstacles that make use of the track enjoyable rather than a mobile agent just DAV simply moving forward in the same pattern over and over again.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A customizable track construction for controlling movement of a self-propelled mobile agent on a surface of the track construction comprising:

a bottom layer having a plurality of machine-readable codes, wherein at least one machine-readable code indicates a location on the surface; and a removable top layer comprising a flexible elongated playscape tape that is formed of a flexible material that has a first surface that has printed indicia formed thereon and a second surface that carries an adhesive material on an underside thereof, wherein the top layer is joined to the bottom layer to form the track construction and the adhesive material has low tack properties to allow the top layer to be removed and repositioned if necessary.

2. The customizable track construction of claim 1, further including a tape core roll on which the track construction is wound.

3. The customizable track construction of claim 1, wherein the track construction comprises a plurality of discrete track segments operatively coupled together or arranged relative to one another to form the track construction.

4. The customizable track construction of claim 1, wherein the machine-readable codes comprise optically readable codes.

5. The customizable track construction of claim 1, wherein the machine-readable codes define at least one path of travel of the surface and encode locations on the surface.

6. The customizable track construction of claim 1, wherein the bottom layer comprises a flexible layer that contains an adhesive material on a bottom surface thereof for adhering the track construction to a support surface.

7. The customizable track construction of claim 1, wherein both the top layer and the bottom layer are flexible and supplied in rolled form.

8. The customizable track construction of claim 1, wherein the top layer has printed indicia representing a road surface and at least one sticker is applied to the top layer.

9. The customizable track construction of claim 8, wherein the sticker is formed of a material that obscures the machine-readable code that lies along the bottom layer below the sticker and thereby represents a road hazard that is configured to alter travel of the mobile agent.

10. The customizable track construction of claim 1, wherein the bottom layer includes a first side region and an opposing second side region with a central region therebetween, the machine-readable codes being disposed within the central region, the second surface of the top layer having a first side region, an opposing second side region and a central region therebetween, the first side region of the top layer overlying the first side region of the bottom layer and the second side region of the top layer overlying the second side region of the bottom layer, the adhesive material being formed exclusively on the first and second side regions such that the central region of the top layer that is free of adhesive material covers the machine-readable codes.

11. The customizable track construction of claim 1, wherein the bottom layer includes a first identification code and there are a plurality of first top layers that make up a first set, each first top layer being identified with a second identification code that indicates that each first top layer is complementary to the bottom layer with the first identification code, wherein the first and second identification codes are formed of a combination of numbers and/or letters, with at least one number or letter being in common with the first and second identification codes.

12. The track construction of claim 1, wherein the playscape tape uses glow-in-the-dark ink on its printed surface for allow for visibility in the dark.

13. The track construction of claim 8, wherein the at least one sticker is formed of an opaque material that prevents an underlying machine-readable code, formed as part of the bottom layer, from being read by the mobile agent and thereby acts as a penalty since control over the mobile agent is temporarily lost.

14. The track construction of claim 8, wherein the at least one sticker has a machine-readable code as a part thereof that is separate from the machine-readable code of the bottom layer.

15. The track construction of claim 14, wherein the at least one sticker comprises a top layer on which printed indicia is formed; an intermediate layer on which the machine-readable code is formed; and a bottom blocking layer; wherein the top layer is formed of an optically transmitting material to allow the mobile agent to read the machine-readable code formed as part of the intermediate layer; and the bottom layer is formed of an optically non-transmitting material that prevents the machine-readable code of the bottom layer that underlies the at least one sticker from being read by the mobile agent.

16. The track construction of claim 8, wherein an adhesive bottom layer of the at least one sticker has low tack properties to allow the at least one sticker to be removed and repositioned on the top layer at a different location.

17. The track construction of claim 1, wherein at least one machine-readable code corresponds to an overlying area of printed indicia of the top layer and there is a correlation between content of the overlying area of printed indicia and action that is undertaken by the mobile agent once the at least one machine-readable code is read by the mobile agent.

18. The track construction of claim 17, wherein the machine-readable code is configured to instruct the mobile agent to perform at least one of the following actions: adjust speed up or down, and turn regardless of any track location identification that is encoded in the machine-readable code.

19. The track construction of claim 17, wherein the printed indicia represents and depicts a road hazard and the corresponding at least one machine-readable code is configured to instruct the mobile agent to perform at least one of the following actions: adjust speed up or down, and turn.

20. The track construction of claim 1, wherein the at least one machine-readable code comprises printed matter that is formed of a material that is detectable by an infrared sensor.

21. The track construction of claim 1, wherein the top layer is formed of a paper stock that is transparent to non-visible light.

22. The track construction of claim 1, wherein the top layer is formed of a polymeric film that is transparent to non-visible light.

23. A customizable track segment for use in a track construction for controlling movement of a self-propelled mobile agent on a surface of the track construction comprising:

a bottom layer having a plurality of machine-readable codes, each machine-readable code indicating a location on the surface; and a removable top layer comprising a flexible elongated playscape tape that is formed of a flexible material that has a first surface that has printed indicia formed thereon and a second surface that carries an adhesive material on an underside thereof, wherein the top layer is joined to the bottom layer to form the track segment.

24. The track segment of claim 23, wherein an underside of the bottom layer includes an adhesive material to allow the track segment to be releasably adhered to a support surface.

25. The track segment of claim 23, wherein the printed indicia formed as part of the top layer depicts at least one of a street sign, a road hazard, track side rails and track environment.

26. The track segment of claim 23, further comprising a sticker that includes a machine-readable code that is formed as a part thereof for controlling operation of the mobile agent.

27. The track segment of claim 26, wherein the sticker includes a blocking layer disposed below the machine-readable code of the sticker that prevents an underlying machine-readable code, formed as part of the bottom layer, from being read by the mobile agent.

28. The track segment of claim 26, wherein the machine-readable code is printed on a layer of the sticker that lies below a print layer that includes printed indicia that is visible.

29. The track segment of claim 23, wherein the track segment comprises at least one of a curved road section and a road intersection.

30. A customizable track segment for use in a track construction for controlling movement of a self-propelled mobile agent on a surface of the track construction comprising:

a bottom layer having a plurality of machine-readable codes, each machine-readable code indicating a location on the surface; and a removable top layer comprising a flexible elongated playscape tape that is formed of a flexible material that has a first surface that has printed indicia formed thereon and an opposing second surface, wherein the second surface of the top layer is joined to the bottom layer to form the track segment.

31. The track segment of claim 30, wherein the second surface includes an adhesive for attaching the top layer to the bottom layer.

32. The track segment of claim 30, wherein the playscape tape uses ink on its printed surface that is blacklight sensitive.

33. The track segment of claim 30, further including at least one sticker applied to the top layer, the at least one sticker having a machine-readable code as a part thereof that is separate from the machine-readable code of the bottom layer.

34. The track segment of claim 30, wherein the bottom layer comprises a flexible layer that contains an adhesive material on a bottom surface thereof for adhering the track construction to a support surface.

35. The track segment of claim 30, wherein the top layer and bottom layer are joined by one of an adhesive, mechanical fasteners, lamination or a combination thereof.

36. The track segment of claim 30, further including at least one sticker applied to the top layer, the at least one sticker being formed of an opaque material that prevents an underlying machine-readable code, formed as part of the bottom layer, from being read by the mobile agent.

* * * * *